US006367522B1

(12) United States Patent
Tyer

(10) Patent No.: US 6,367,522 B1
(45) Date of Patent: Apr. 9, 2002

(54) SUSPENDED MARINA/WATERCRAFT FUELING SYSTEM AND METHOD

(75) Inventor: John C. Tyer, Roseville, CA (US)

(73) Assignee: FCI Products, Inc., West Sacramento, CA (US)

( * ) Notice: Subject to any disclaimer, the term of this patent is extended or adjusted under 35 U.S.C. 154(b) by 0 days.

(21) Appl. No.: 09/627,472

(22) Filed: Jul. 27, 2000

Related U.S. Application Data

(60) Provisional application No. 60/146,434, filed on Jul. 29, 1999.

(51) Int. Cl.[7] ..... B65B 1/04

(52) U.S. Cl. ..... 141/387; 141/86; 114/230.1; 114/258

(58) Field of Search ..... 141/387, 388, 141/389, 86–88; 114/230.1, 231, 264, 230.15–230.27, 258–263, 196

(56) References Cited

U.S. PATENT DOCUMENTS 3,712,330 A * 1/1973 Davis
4,281,611 A * 8/1981 Vilain
4,418,718 A * 12/1983 Fusy
5,261,773 A * 11/1993 Thomas
5,884,657 A * 3/1999 Srock

* cited by examiner

*Primary Examiner*—Steven O. Douglas
(74) *Attorney, Agent, or Firm*—John P. O'Banion

(57) ABSTRACT

A system and method for the safe conveyance of fuel from the shore to a floating watercraft refueling dock. A cable is stretched between a floating dock to a cable support structure on the shore which contains a reel for adjusting the length of the cable in response to changes in floating dock position, as in response to changing water levels. A fuel hose is suspended underneath the cable by removable lanyards. The fuel hose is connected on the shore to a hose reel which allows the length of hose to be adjusted in accordance with the cable length. Fuel is supplied through the hose on the hose reel along the suspended span of fuel hose to fuel dispensers on the floating fuel dock. The suspended fueling system retains the fuel hose off the terrain and is capable of being retracted or extended to accommodate the rise and fall of the floating dock in response to the water rising and falling. Aspects of the invention include an ability to provide secondary containment from shore to dispenser, and additional safety features.

40 Claims, 18 Drawing Sheets

SUSPENDED MARINA/WATERCRAFT FUELING SYSTEM AND METHOD

CROSS-REFERENCE TO RELATED APPLICATIONS

This application claims priority from U.S. provisional application serial No. 60/146,434 filed on Jul. 29, 1999, which is incorporated herein by reference.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to fueling systems for marine watercraft and more particularly to a suspended watercraft fueling system.

2. Description of the Background Art

Marinas provide locations for the docking and refueling of both recreational and commercial watercraft. A vast number of marinas employ floating refueling docks that provide quick access for watercraft refueling. Fuel is often conveyed to these floating refueling docks through a combination of pipes and hoses (single wall) that are positioned over terrain and submerged in the waterway to connect the dock with an on-shore fuel tank. Conveying fuel in this manner is not a safe practice, as the fuel pipes and hoses are subject to environmental exposure, damage, and wear. As a result of such pipe/hose damage, or damage to any of the myriad connections along the fuel path, an unchecked fuel flow may be discharged into the waterway. Currently, it is common to find leaky fuel connections at marinas, while equipment failures result in the release of substantial quantities of fuel into the environment. These methods for conveying fuel to a floating dock also pose a significant fire danger due to the ease with which a fuel hose laying over terrain and portions of the waterway may be compromised.

Safety problems inherent in conveying fuel by the aforesaid methods are further exacerbated by movements of the floating dock, as may occur in response to water level changes. The length of fuel hose necessary to provide a supply of fuel to a floating dock varies with the position of the dock, which is largely determined by changes in the water level. Typical installations accommodate such changes by providing a length of fuel hose adequate for the longest distance that should ever be need to be traversed. Under normal conditions, a large amount of slack fuel line remains strewn on the terrain and waterway. Use of a hose reel to take up the slack hose is contraindicated in these installations, as it will actually increase the amount of hose wear, since the hose will then be subject to abrasion as it is dragged back and forth across the terrain in response to dock level changes. The fuel supply hoses, therefore, are typically laid out on the terrain where they are vulnerable to both human activity and environmental conditions. Furthermore, this vulnerability can result in dock fires as the leaking fuel encounters an ignition source, such as a spark. It is not surprising that fuel spills and fires are common occurrences on our waterways as a result of fuel hoses that have become worn, or that fail to maintain containment of the fuel they supply.

The conveyance of fuel from the shore to a floating dock has therefore been met with a number of challenges that have not been fully addressed: (1) flexibility of the system to the changing distances and levels from the dock to the shore, (2) fire resistance, (3) spill prevention, (4) spill containment, (5) durability, and (6) ease of use. Therefore a need exists for a safe and convenient method and system for conveying fuel from the shore to a floating dock which meets the aforesaid challenges. The present invention satisfies those needs as well as others, and overcomes deficiencies in previously developed methods.

BRIEF SUMMARY OF THE INVENTION

The present invention is capable of safely conveying fuel from the shore to a floating dock so that fuel may be easily dispensed to watercraft while preventing contact between the hose and the underlying terrain or water. The system provides for suspending a fuel hose beneath a cable stretched from the shore to the floating dock. The fuel hose is attached to the cable by a set of removable supports, or lanyards. A pair of reels, preferably mounted on the shore, provides a mechanism for adjusting the length of the cable and fuel hose to accommodate changes in the position of the floating dock. Floating dock position changes may occur, for instance, in response to periodic water level changes which may happen as a result of tide changes or seasonal variation. The system preferably utilizes a fuel hose surrounded by a secondary containment wall and containment reservoirs under each hose coupling so as to contain any spills that may arise should a portion of the system be compromised. In addition, the system preferably includes both fuel and electrical breakaways at strategic locations, such as at the point of joining the floating dock, and containment reservoirs that reduce spill and fire danger.

An object of the invention is to provide the capability of retaining a fuel hose above the ground and/or waterway between the shore and the floating dock.

Another object of the invention is to provide a system for safely conveying fuels to a floating dock wherein the danger of spillage and fire is substantially reduced.

Another object of the invention is to reduce the environmental and safety risk should a component in the conveyance system be compromised.

Another object of the invention is to reduce the risk of spillage and the possibility of an electrical hazard should the dock or fuel dispenser be subject to a high-impact collision.

Another object of the invention is to provide a fuel conveyance system in which the amount of fuel hose retained between the floating dock and the shore is easily adjusted in accord with dock position.

Another object of the invention is to provide a fuel conveyance system that can be implemented for a variety of waterway environments, such as oceans, deltas, lakes, and rivers.

Another object of the invention is to provide a fuel conveyance system that provides the capability of suspending a fuel hose over an extended span of terrain or water.

Another object of the invention is to provide for fuel hose movement over a support structure without the necessity of removing the lanyards.

Another object of the invention is to provide a fuel conveyance system wherein a fuel hose adapted with a secondary containment hose may be safely routed along structures, such as docks.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings, which are for illustrative purposes only.

DETAILED DESCRIPTION OF THE INVENTION

Referring more specifically to the drawings, for illustrative purposes the present invention is embodied in the apparatus generally shown in FIG. 1 through FIG. 25. It will be appreciated that the apparatus may vary as to configuration and as to details of the parts, and that the method may vary as to the specific steps and sequence, without departing from the basic concepts as disclosed herein.

Figure 1:
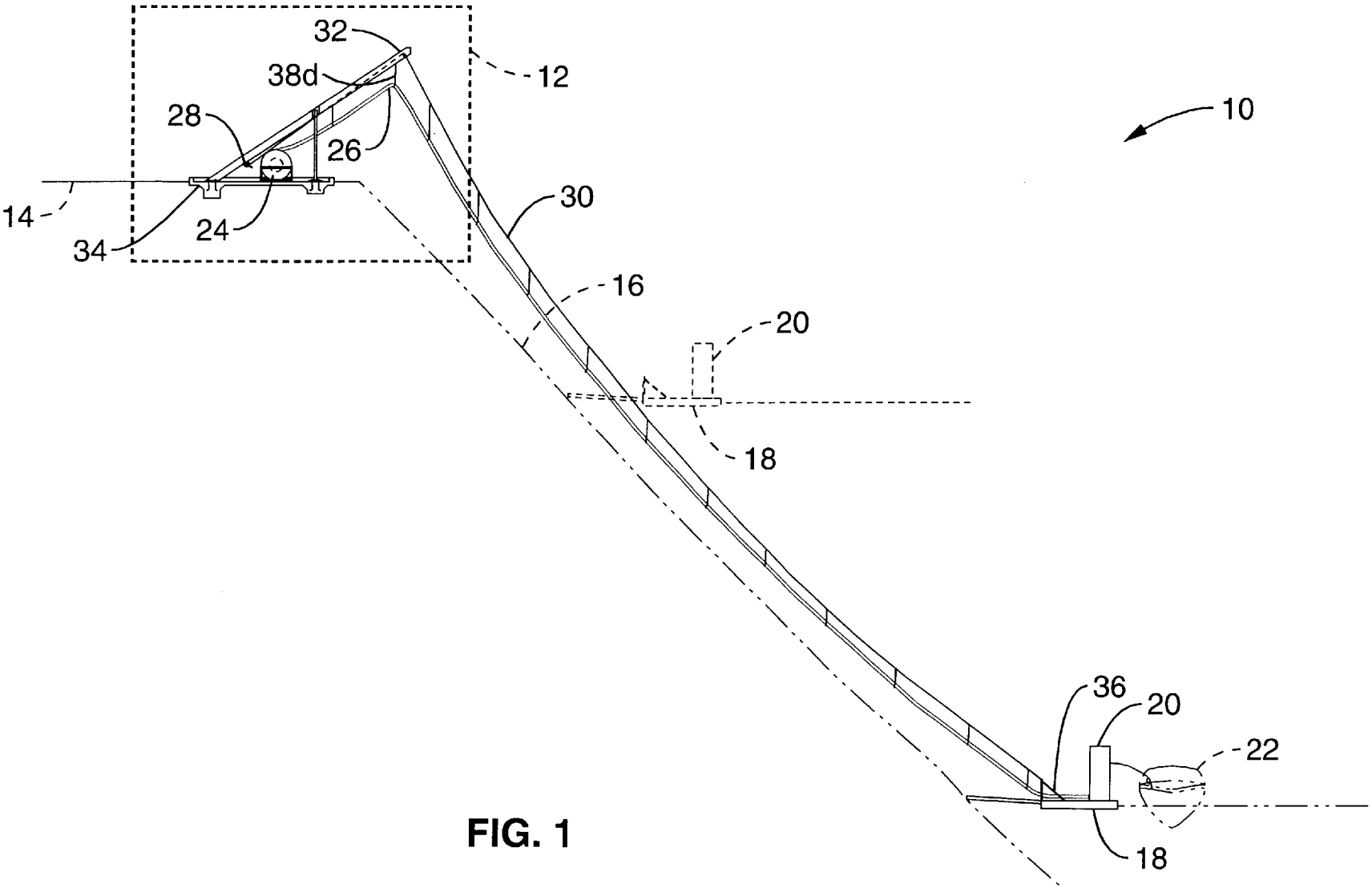
FIG. 1 is a side view of a suspended marina/watercraft fueling system in connection with a floating dock in accordance with the present invention.

FIG. 1 shows an embodiment of a suspended fuel conveyance system 10 for transferring fuel from the shore to a dock which is floating on a waterway whose water level is at the low water mark. A cable support structure 12 is positioned at the top 14 of embankment 16 which leads down to the water line. A floating dock 18 having a fuel dispenser 20 is shown at the low water mark with a watercraft 22 being refueled. The dock 18 is additionally shown in phantom floating at the high water mark to provide a perspective of hose length variation accommodated by the suspended fuel system in response to vertical and horizontal changes of dock position. The situation depicted is typical of a lake in which a substantial variation in seasonal water level occurs. The suspended fuel system of the present invention accommodates these vertical and horizontal displacements resulting from the water level changes. In a typical installation, the length of fuel hose would be retained at least two feet above the terrain over a span ranging between fifty and one-hundred-fifty feet.

A fuel hose reel 24 provides for extension and retraction of a fuel hose 26. A cable reel 28 similarly provides for the extension and retraction of a cable 30. The fuel hose 26 is suspended from the cable 30 which is held a sufficient height above the terrain by the cable support structure 12 having a pair of support arms 32*a*–32*b*. The cable support structure 12 is positioned within a containment basin 34 having raised lips that form a reservoir for the containment of spilled fuel in the event that leakage occurs within the hose or connections proximal to the hose reel. The cable 30 is suspended above the terrain between the top of the cable support structure 12 and a dock-side cable support 36 which is attached to the dock and configured to receive the fuel hose and electrical power cord suspended within the cable. A series of flexible supports, or lanyards, such as 38*d*, are shown along the cable span from which a fuel hose is suspended.

Figure 2:
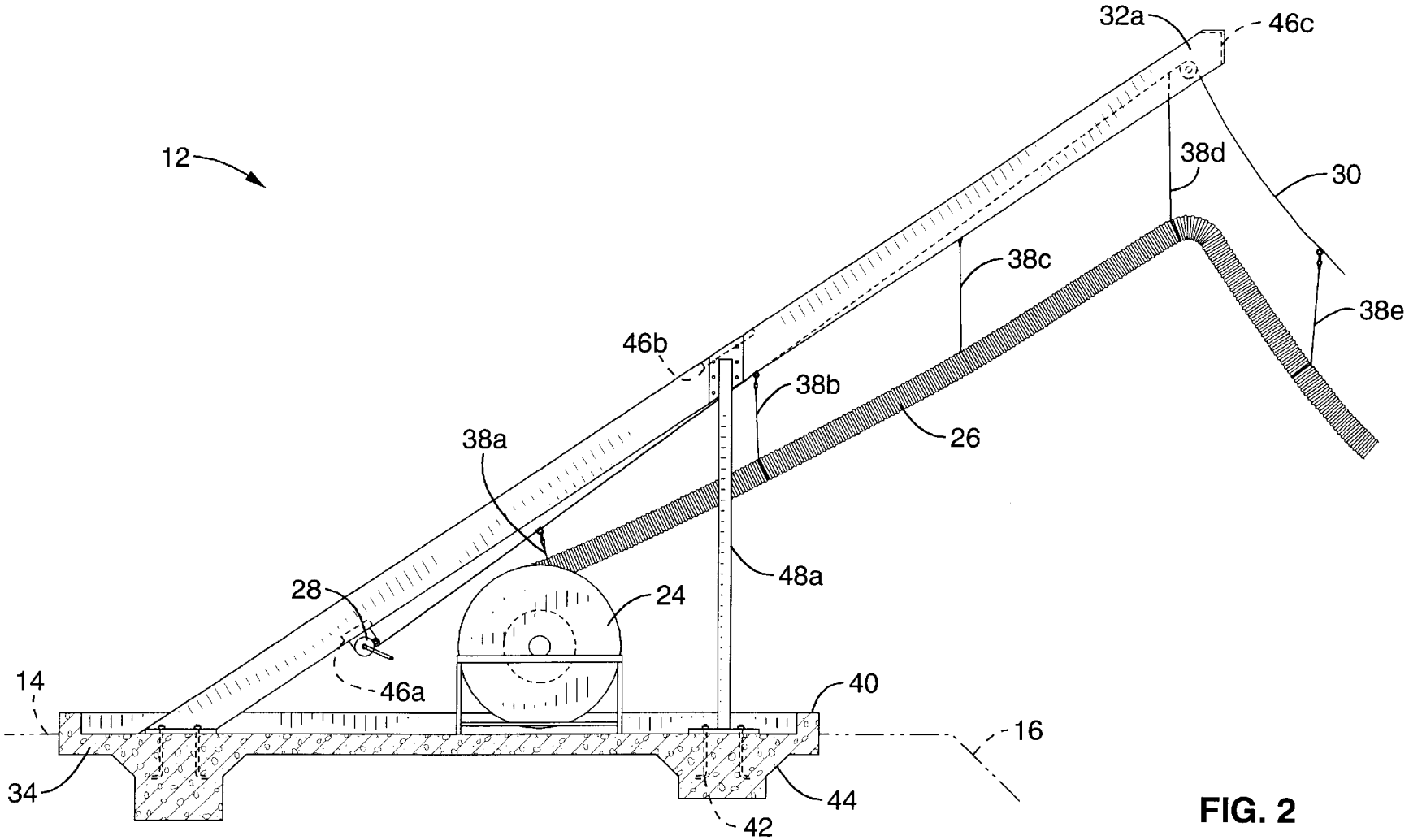
FIG. 2 is a side view of the cable support device according to the present invention showing the fuel hose suspended from the cable by lanyards.
Figure 3:
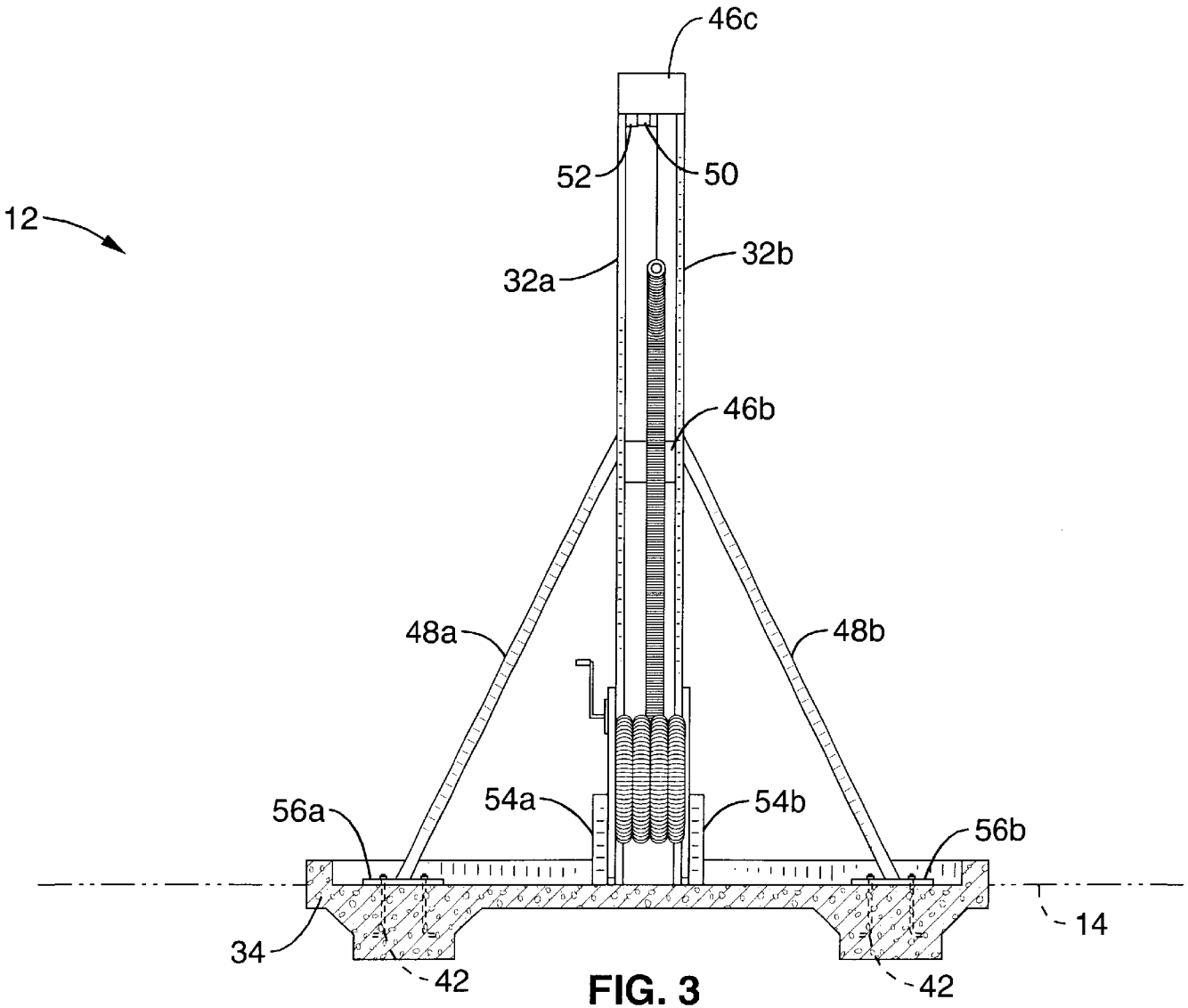
FIG. 3 is a front view of the cable support device of FIG. 2.

FIG. 2 and FIG. 3 show a detailed view of the cable support structure 12 mounted on top of the embankment 14 within a containment basin 34 having a raised lip 40 to form a container in which leaking fuel will be retained. The cable support structure is shown mounted via J-bolts 42 into the footings 44 of the poured concrete containment basin 34. One support arm 32*a*, of a pair of sheave supports arms 32*a*, 32*b*, are shown with a proximal end attached to the containment basin and a distal end rising above the terrain and configured for receiving the cable 30, which is preferably a ⅜ inch stainless steel cable. The fuel hose 26 is suspended from the span of cable 30 by lanyards 38*a* through 38*e*, which are preferably spaced at six-foot intervals. Various reels may be used upon which to wind the cable and fuel hose. The hose reel 24 of the embodiment is shown employing a 9000 series hose reel manufactured by Hannay Reels Incorporated®. It will be understood that the power for retraction and extension of the hose from the hose reel may be supplied by any power source capable of being coupled to the reel, such as by manual operation or operated by a motorized system. To minimize the risk of both spillage and fires, a fuel hose is preferably configured with an outer secondary containment sleeve annularly disposed about an inner primary hose. The fuel is conveyed through the inner primary hose while the outer sleeve provides secondary fuel containment in the event of a leak in the primary hose. The primary fuel hose utilized within the illustrated embodiment is a Goodyear® marine fuel line USCG/SAE J1527 type 1A, ISO 7840-A1CE with a diameter in the range from ⅝ inch to 1½ inch. The secondary hose for use as a coaxial containment hose in the illustrated embodiment is a conventional 3-inch vapor recovery hose manufactured by Kanaflex™, although similar hose is available from additional manufacturers. The secondary containment hose may in addition retain one or more electrical cords and a vapor recovery hose. The two sheave support arms 32*a*, 32*b*, are interconnected at intervals by support braces 46*a* through 46*c*, the lower one shown supporting the cable reel 28. The cable support structure 12 is supported in a sufficient vertical inclination by support legs 48*a*, 48*b*, which are readily apparent in FIG. 3. Referring now to FIG. 3, the cable support structure 12 has a cable sheave 50 that is retained by a sheave support 52. The cable sheave 50 has a groove for supporting and retaining the cable while it freely rotates to allow easy retraction and extension of the cable. The cable support structure 12 is attached to the containment basin 34 at base attachment plates 54*a*, 54*b*, for the sheave support arms 32*a*, 32*b*, and at base attachment plates 56*a*, 56*b*, for the support legs 48*a*, 48*b*.

Figure 5:
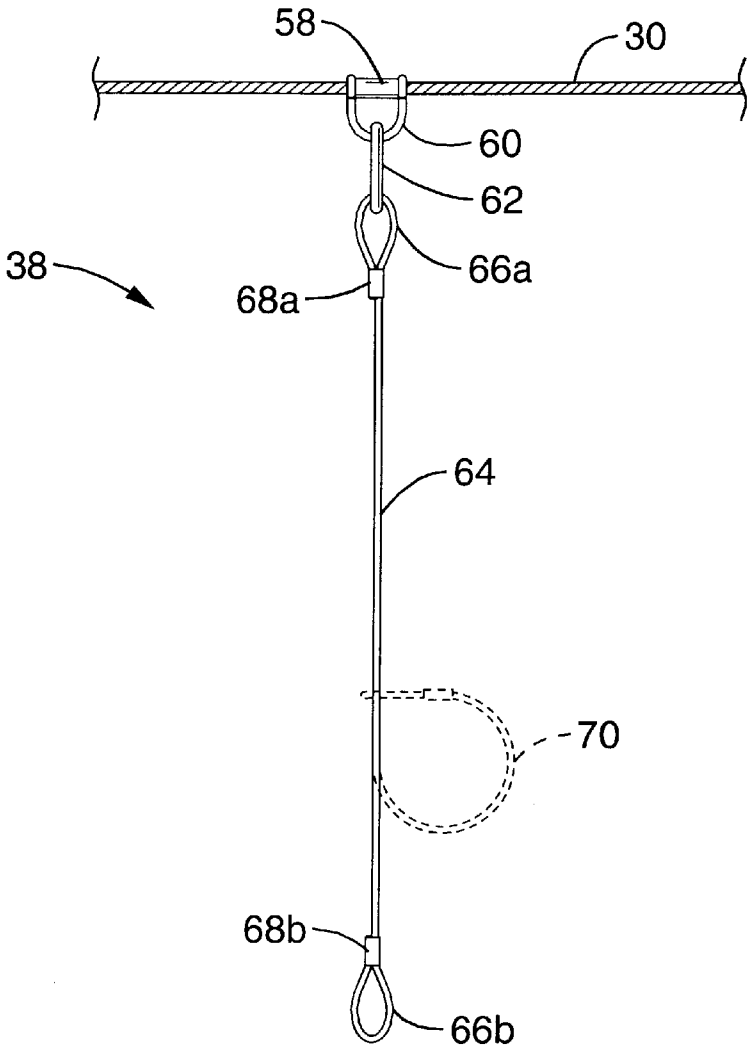
FIG. 5 is an assembled view of the lanyard attachment assembly of FIG. 4 attached to a cable.
Figure 4:
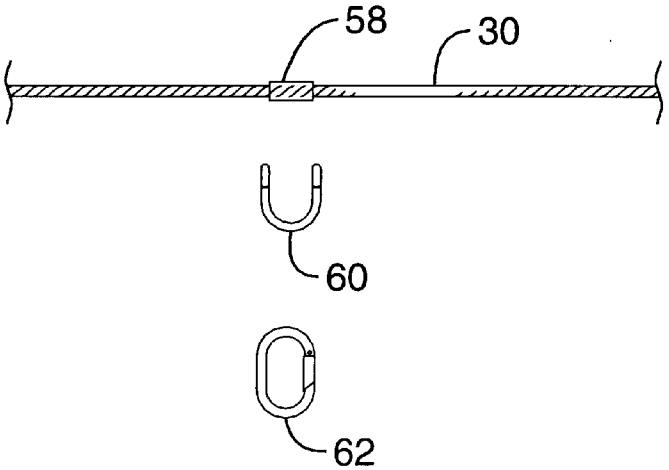
FIG. 4 is an exploded view of a lanyard attachment assembly showing a separate D-shackle and snap link according to one aspect of the present invention.

FIG. 4 and FIG. 5 show a detailed embodiment of an attachment point on the cable for attachment of a lanyard. Referring to FIG. 4, a portion of the cable 30 is shown with a cable attachment device 58 attached by swaging onto the cable 30. Shown separately are a D-shackle (without pin) 60 and a snap-link 62 which is used as shown in FIG. 5 for attaching a lanyard 38 to the D-shackle 60 on cable 30. To permanently attach a D-shackle 60 to the cable, a D-shackle is threaded onto the cable with an uncompressed cable attachment device 58 retained between the pin-holes of the D-shackle. Once the D-shackle with cable attachment device are slid into position on the cable the attachment device is swaged to permanently retain the D-shackle at that position on the cable. After attachment, the retained D-shackle still has rotational freedom about the cable. In FIG. 5 the snap link 62 is shown (in side view) connecting the lanyard 38 to one end of a D-shackle 60 affixed on the cable. The lanyard 38 comprises a length of cable 64, preferably stainless steel, whose ends have been formed into cable end loops (eyes) 66*a*, 66*b*, which are secured by swaged connectors 68*a*, 68*b*. The lanyard 38 may be secured to the fuel hose by wrapping it around the hose with one end of the lanyard 66*a* being passed through the eye at the other end of the lanyard 66*b*, to form a retention loop 70 within which the hose is to be retained (hose not shown in FIG. 5). It will be appreciated that the lanyard may be easily attached and removed from both the cable 30 and from around the hose. It should be further appreciated that once the snap link 62 and lanyard have been removed from the D-shackle 60, the cable 30 having attached D-shackle 60 may be wound around the cable reel. The D-shackles have a minimal effect on cable winding as they are able to rotate about the cable to accommodate a tight winding pattern. The aforesaid description of lanyard fabrication is provided by way of example, and not of limitation, as numerous alternative methods of fabricating a flexible support are available which are capable of being used for suspending a fuel hose beneath a cable.

Figure 7:
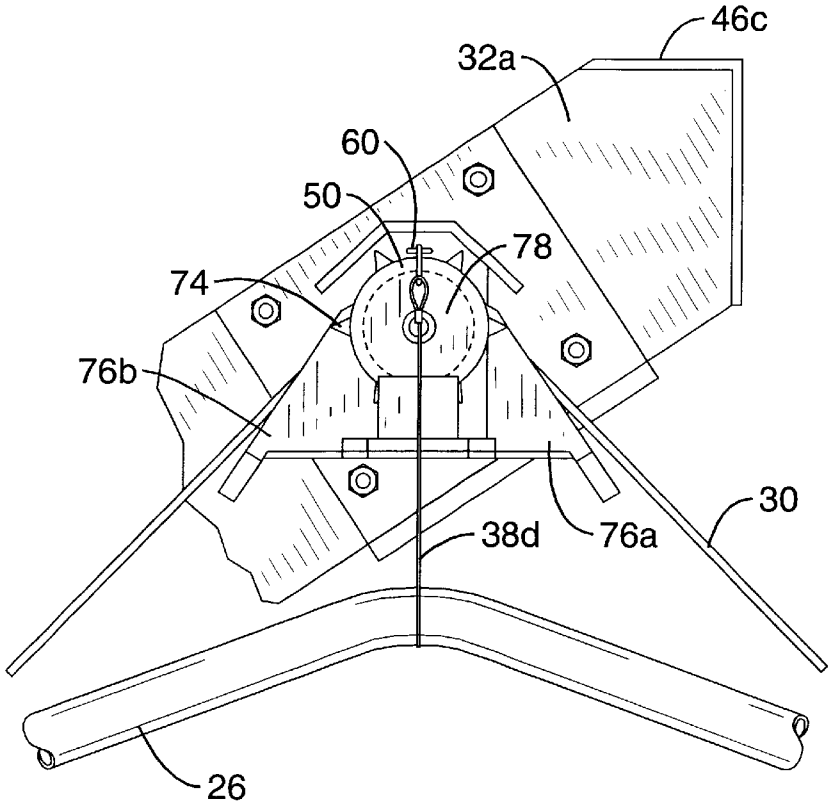
FIG. 7 is a side view of the cable sheave of FIG. 6 as the lanyard transitions past the sheave.
Figure 6:
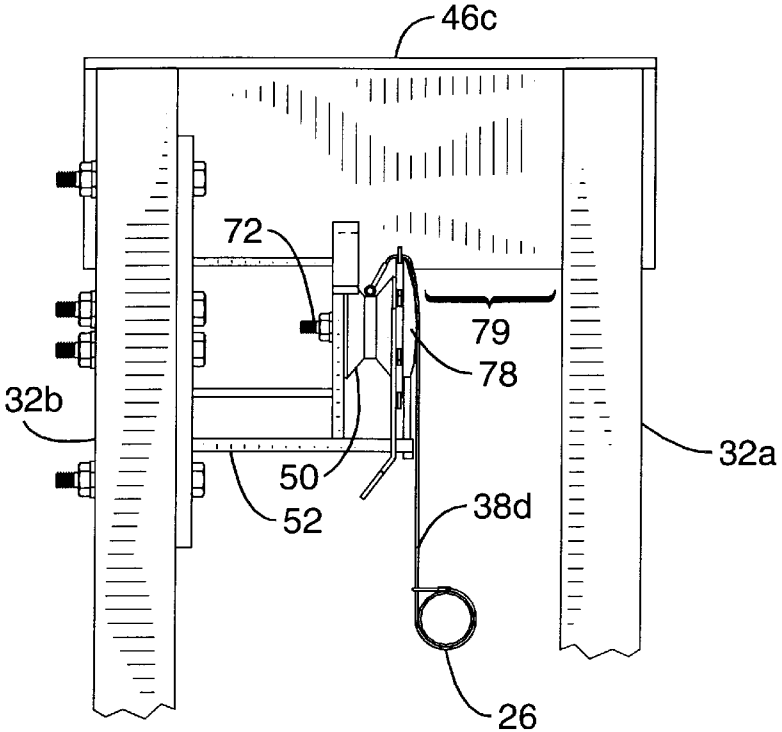
FIG. 6 is an end view of a cable sheave positioned toward the upper-end of the cable support device, shown with a lanyard passing along an open side of the sheave.
Figure 8:
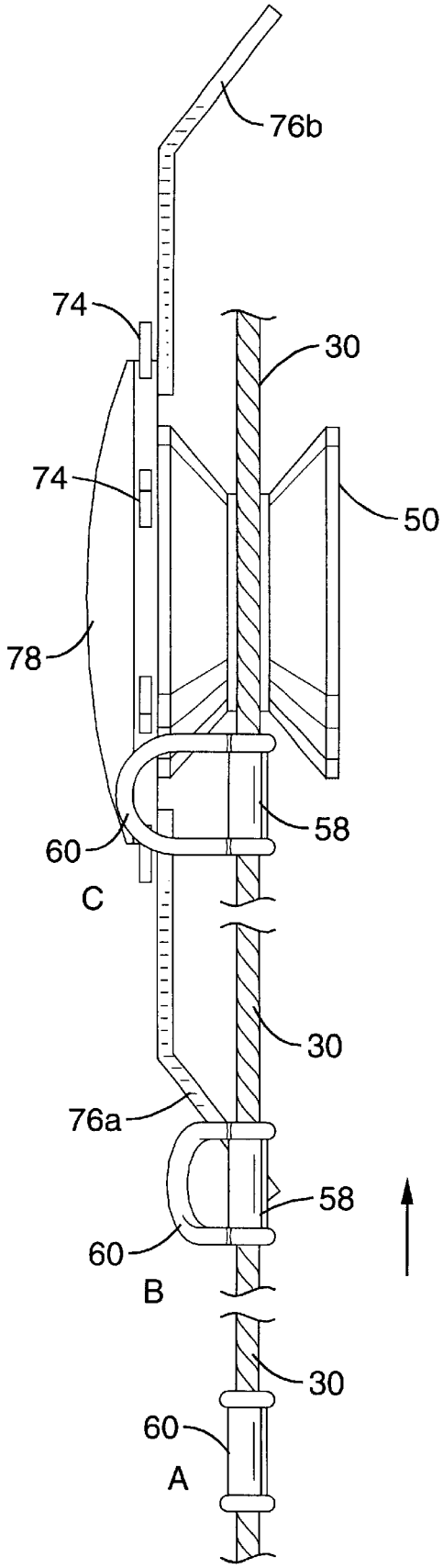
FIG. 8 is a schematic of D-shackle rotation seen from above the sheave as the shackle progresses toward the sheave which is retained by the cable support structure.

FIG. 6 and FIG. 7 illustrate a portion of the cable passing over the sheave 50 wherein a lanyard 38*d* is positioned. The sheave 50 is retained by retention bolt 72, to the sheave support 52, which is bolted to one of the cable support arms 32*b* leaving a space between the sheave and the other support arm 32*a*. The sheave 50 is capable of supporting the weight of the cable with the suspended fuel hose and the sheave 50 rotates on bolt 72 so that the cable may be easily extended and retracted with minimal effort. The combination of cable support structure 12 and sheave 50 provide a mechanism wherein the shore-side support for the cable can be set to any necessary height to provide obstacle and terrain clearance for the attached hose. It will be immediately recognized that the hose and cable may not be taken up on different reels without first detaching the interconnecting lanyard; however, it should also be appreciated that the interconnecting lanyards will prevent the cable with suspended hose from traversing along a conventional sheave. In using a conventional sheave arrangement with FIG. 1, the difficulty of removing lanyards at the top of the support structure should be appreciated, as this would require an operator to traverse back and forth between the reel and a ladder, or similar structure, to reach the sheave. The inventive embodiment solves this limitation by providing a sheave 50 adapted to allow passage of the lanyards 38, so that they need only be removed when that portion of the hose and cable are being wound onto their respective reels. To provide this advantage, the sheave 50 is attached to a single side of the support structure to provide a space 79, through which the vertical lanyard may pass as it traverses toward, or away, from the take-up reels. The D-shackle to which the lanyard is attached normally hangs down below the cable under the weight of the hose as transferred through the lanyard. As the D-shackle 60 arrives toward the sheave support 52 it is directed by a shackle guide 76*a*, 76*b*, that can be seen in FIG. 7 which directs the shackle toward the open side of the sheave (the shackle guide was removed from FIG. 6 for clarity). The lanyard 38 is assisted to pass over the sheave by a sprocket having exterior protrusions 74, or cogs, attached to the sheave, which catch the D-shackle 60 to assist it in moving over the sheave. The D-shackle is then able to pass over the sheave with the attached lanyard 38 guided by the stationary domed lanyard guide 78 through the space 79, as shown in FIG. 6. A schematic representation of D-shackle rotation is shown in a top view in FIG. 8, wherein the support structure has been removed to more clearly illustrate the active elements. A D-shackle is shown at three positions as it traverses the cable path. At position "A" the D-shackle 60 is hanging straight down away from view. At position "B" the D-shackle has encountered the shackle guide 76*a* and is beginning to rotate about the cable. Upon reaching position "C" the D-shackle is nearly fully rotated and is beginning to engage the protruding cogs 74 which assist transit of the swaged coupling of the D-shackle over the sheave 50. For the sake of clarity, FIG. 8 does not depict the snap link and lanyard attachment to the D-shackle; however, it will be recognized that these elements will move following their point of attachment such that the lanyard will pass the sheave guided by the domed lanyard guide 78. The three D-shackle positions are shown in close proximity, although it will be recognized that they would preferably be spaced at substantially larger intervals. The need for shackle guides 76*a*, 76*b*, on either side of the sheave 50 will be readily understood as the cable with the attached D-shackles is subject to both retraction and extension from the cable spool in response to changes in the position of the floating dock.

Figure 10:
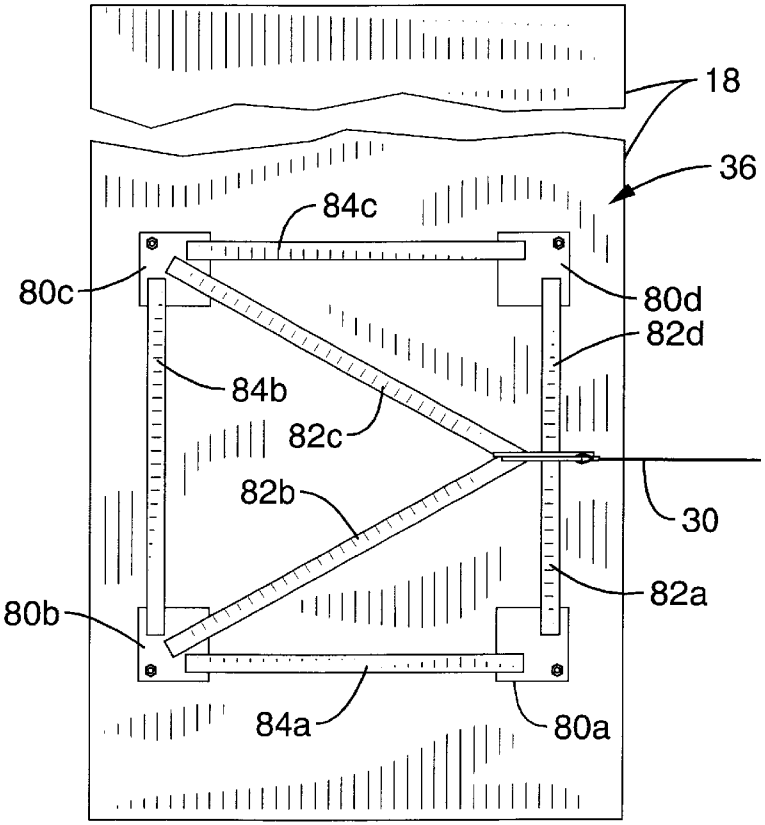
FIG. 10 is a top view of the dockside cable support of FIG. 9 shown for clarity without either fuel or electrical connections.
Figure 9:
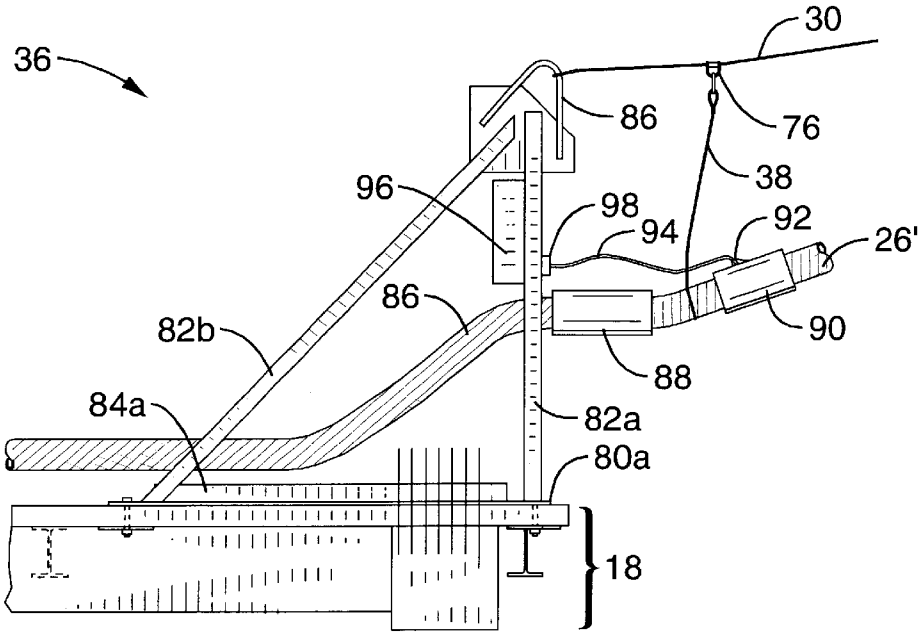
FIG. 9 is a side view of a dockside cable support structure according to an aspect of the present invention, shown with the fuel hose support cable attached.

FIG. 9 and FIG. 10 illustrate a representative dockside cable support 36, which may be used for attaching the cable in order to support a length of suspended fuel hose and cable being received from the shore. By way of example, the dockside cable support 36 is a welded steel structure attached to a portion of a floating dock 18 by dock attachment plates 80*a* through 80*d*, which are bolted to the dock. Numerous alternative dock fastening methods may be employed depending on dock structure and the strength requirements for the specific installation. A set of vertical support braces 82*a* through 82*d* provide risers to support the cable a sufficient distance above the dock surface. The dock attachment plates 80*a* through 80*d*, are connected to one another and to the vertical support braces 82*a* through 82*d* by horizontal support braces 84*a*–84*d*. Fastened to the vertical support braces 82*a* through 82*d*, is a cable attach structure 86 shown with a terminating portion of the cable 30 attached. It will be appreciated that the dockside cable support 36 may be fabricated at any desired height, as determined by the specific terrain and distance associated with a particular installation. The dockside support structure 36 within this embodiment preferably receives the fuel hose, adapting it for connection to the floating dock, by way of a fuel hose interface which is configured with a dual-wall breakaway disconnect 88. The last five to ten feet of the fuel hose 26 preferably comprises a fire rated section of hose 26', such as a Hosemaster® fire-rated 3-inch flex connector. The use of a fire-rated section of hose 26' in the transition from the flex hose to the rigid pipe of the floating dock. The fire rated flexible hose provides additional protection from heat and flames in the event of a dock fire. Sections of fire rated flexible hose may typically be identified by their braided stainless steel oversleeve, which is represented by the cross hatching of the hose section 26'. The dual-wall breakaway disconnect 88 prevents fuel leakage by providing a controlled separation of the fuel hose. Hose separation at the disconnect may occur if the dock is subjected to substantial movement, or is torn away from its mooring, for instance as the result of a boat forcefully colliding with the dock. The fuel hose 26' under a sufficient displacement force separates at the dual-wall breakaway disconnect 88. The dual-wall breakaway disconnect for the depicted installation is preferably configured to separate upon encountering a force that exceeds 600 pounds. The dual-wall breakaway disconnect provides an inner primary breakaway disconnect housed coaxially within a secondary containment pipe so that upon disconnection of the breakaway, fuel flow is prevented through either one of the separated primary hose sections as internal valves close within each half upon separation. A single valve may employed within the breakaway disconnect to stop fuel flow from only one end of the disconnected hose, however, this would not be a preferred implementation. The fuel hose 26, 26'is preferably configured with an inserted electrical cord which exits the hose within an electrical cord exit coupling 90 wherein a cord exit fitting 92 provides a liquid-tight seal on the electrical cord 94 which is routed to an electrical box 96 through a connection fitting 98. A short span of electrical cord is shown for clarity, however, it will be appreciated that providing slack in the cord increases the compliance of the connection to movement of the dock.

Figure 11:
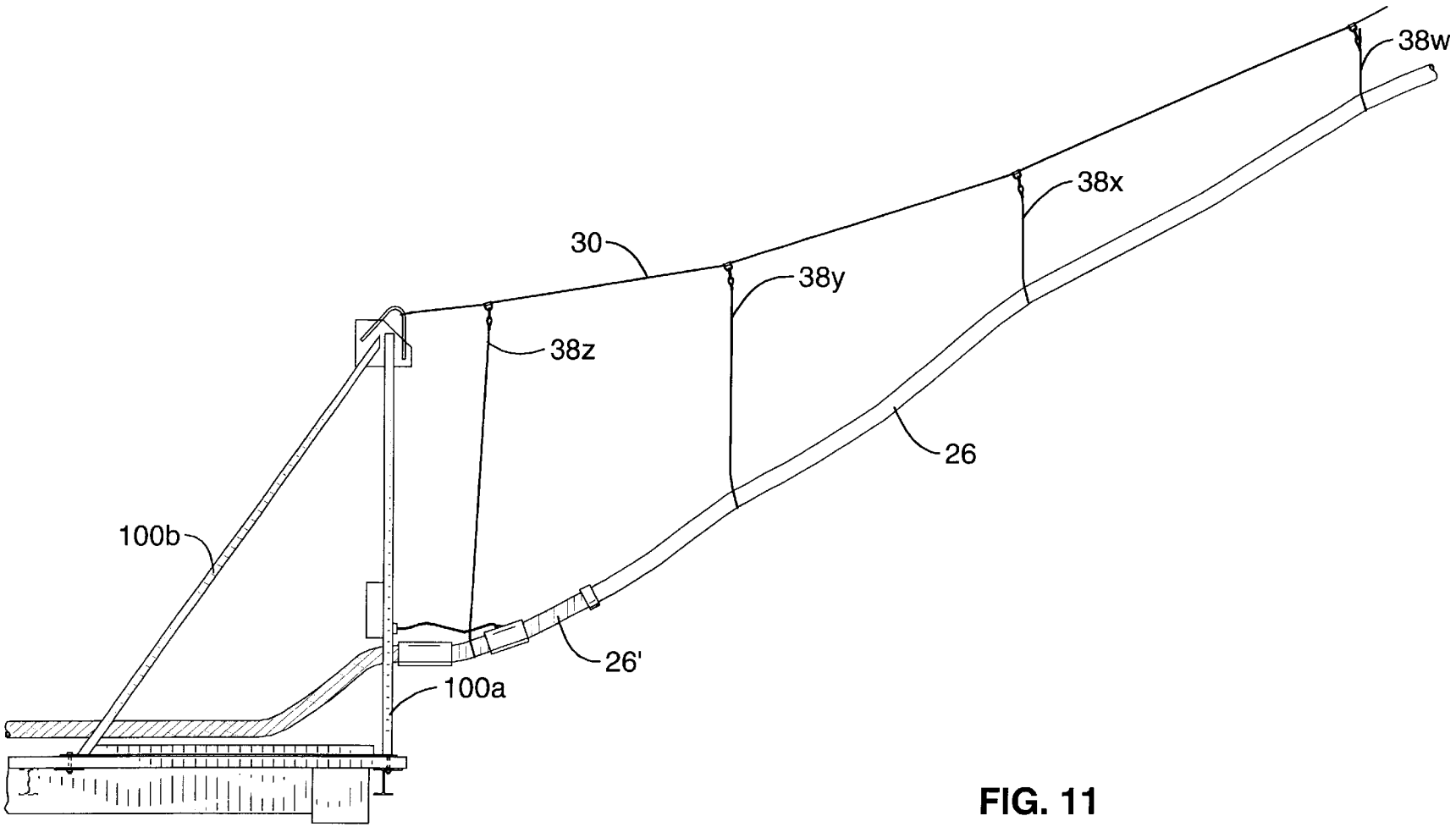
FIG. 11 is a side view of an extended version of the dockside cable support structure according to an aspect of the present invention shown with varied length lanyards approaching the support structure.

The lanyards used for supporting the fuel hose from the cable have been shown as being of equal length, however, these lanyards may be sized to suit the installation and cable path. For example, progressively shorter lanyards may be used mid-span so that the hose need not follow the parabolic curve of the suspension cable. If variously sized lanyards are utilized, then it will be convenient to either color code or number the lanyards and D-shackle positions along the cable span so that the lanyards may be properly attached at the correct locations as the cable is extended. Furthermore, in considering the hose span from shore to floating dock, it will be readily understood that during normal use the cable will never be fully retracted, as this would place the dock directly adjacent to the shore mounted reels. Therefore, the lanyards near the dock will not be required to pass through the sheave and thereby may be fabricated in a longer length. Longer lanyards can provide benefits when utilized in conjunction with a tall dockside support structure to achieve additional ground clearance for the hose. FIG. 11 shows an example of a tall dock-side support structure that may be utilized to maintain the fuel hose at a higher distance above the ground (or water) near the dock area or to provide proper mid-span terrain clearance without further increasing the height of the shore side cable support structure. The support structure of FIG. 11 is of the same design as that of FIG. 10, however longer vertical supports 100a–100*d* are incorporated (100*c*, 100*d*, are hidden in this view). As can be seen from FIG. 11, the lanyards nearest the dock 38*x* through 38*z* are extended in length relative to 38*w*, so as to properly transition the hose from a higher support position to the floating dock. It will also be realized that to achieve fuel hose clearance above ground, i.e. to allow persons to transit underneath, the fuel hose may be received near the top of the dock-side support structure and routed downward to the dispenser by double-wall flexible hose or double-wall rigid sections having curving transition elbows at the top and bottom.

Figure 12:
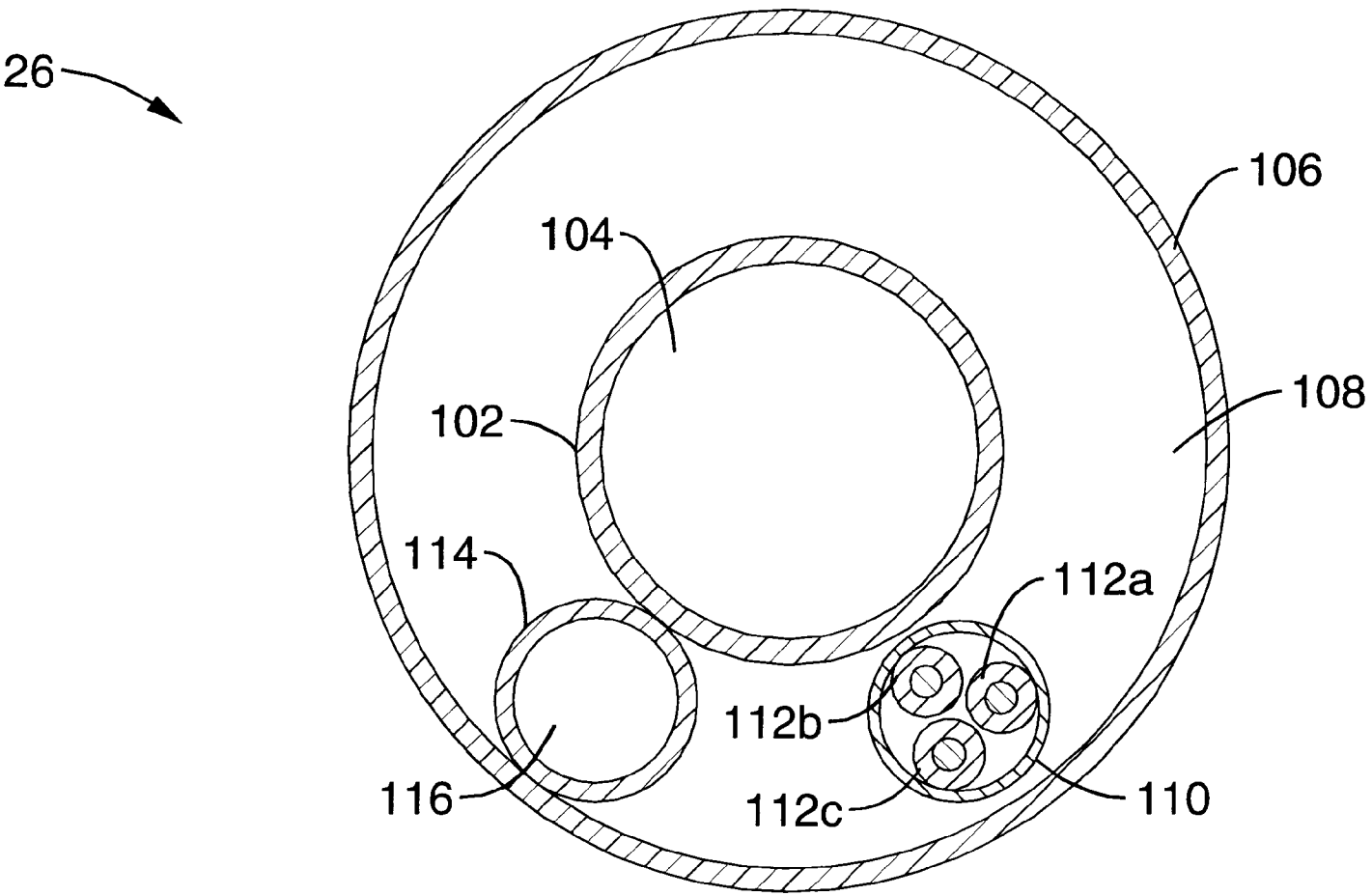
FIG. 12 is a cross-sectional view of a fuel hose having a secondary containment wall within which is contained a three-wire electrical cord and an optional vapor recovery hose.

FIG. 12 shows a preferred configuration for the fuel hose 26, as a double-wall hose having a primary hose wall 102 with an inner region 104 through which liquid fuel is conveyed. The primary hose is contained within a secondary containment hose having hose wall 106 and an inner region 108 for the collection of any spills and optionally providing for the routing of additional hoses and pipes. Shown in FIG. 12, is an electrical cord 110 contained within the secondary containment hose that provides a set of three insulated wires 112*a* through 112*c* that are surrounded by a sheath. The electrical cord 110 should be approved for exposure to water, oil, and the environment. In addition an optional vapor extraction hose 114 provides the ability to carry fuel vapors from the dispenser nozzle back to the fuel tank along a vapor path 116. It will be appreciated that signal cables or additional hoses may be routed through the secondary containment area 108 of the hose. The exemplified secondary hose has a diameter of three inches; however, the present invention may be practiced with hoses to suit a variety of installations. Typical fuel transfer installations will require a primary hose of from ⅝ inch to 4-inch diameter, with secondary hoses sized accordingly up to approximately a 6-inch diameter.

Figure 13:
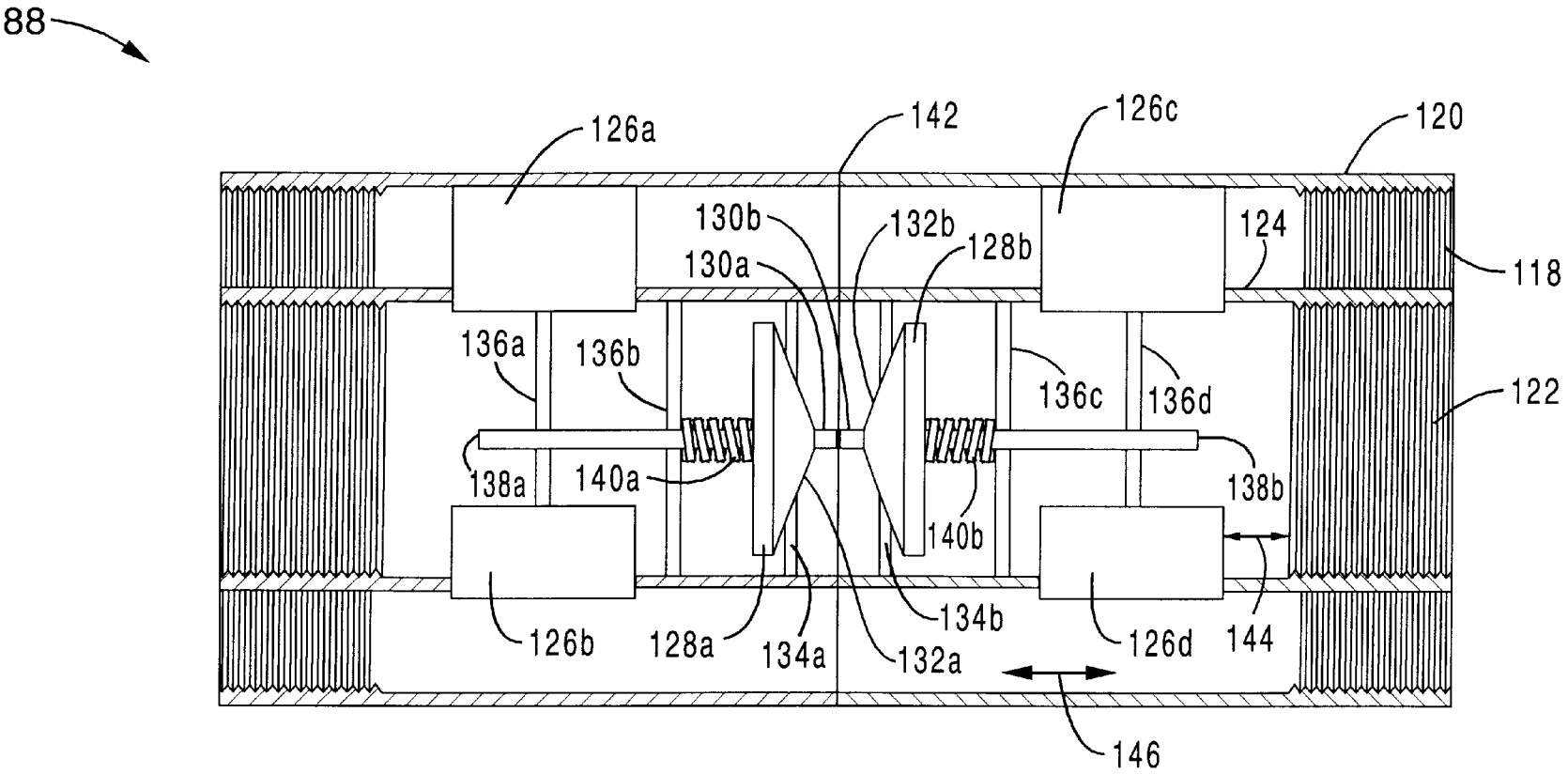
FIG. 13 is a cross-sectional view of a coaxial hose breakaway disconnect, which provides primary disconnection while maintaining secondary containment along the span of fuel hose.

FIG. 13 shows a double-wall breakaway fuel pipe connection 88, which provides for secondary containment when used along the span of fuel hose from shore to dock. The breakaway 88 shown, provides for shutting off the fuel passing through the primary hose when the two halves of the coaxial connection are separated. Unlike a traditional single pipe breakaway disconnect, this dual-wall breakaway disconnect is for use within a double-wall pipe which provides for secondary fuel containment. The breakaway comprises a 3" NPT connection 118 for connection to the 3" secondary containment hose and has an outer wall 120. A primary 2" NPT connection 122 allows connection to the fuel hose and has an inner (primary) wall 124 within which the fuel is carried. Numerous stabilizer fins 126*a* through 126*f* (hidden within this view are 126*e*, 126*f*) surround the primary breakaway and fix it in a position (preferably centered) within the secondary containment pipe. A pair of fluid shut-off valves 128*a*, 128*b*, are actuated into a closed position (stopping fuel flow) when the hold-open pins 130*a*, 130*b*, are no longer in compression against one another, wherein the valve faces 132*a*, 132*b*, contact the valve seats 134*a*, 134*b*. The valves 128*a*, 128*b*, are retained by a set of internal supports 136*a* through 136*d*, through which plunger rods 138*a*, 138*b* are actuated by biasing springs 140*a*, 140*b*. The breakaway point 142 is shown on the pipe, which under normal conditions (connected) provides a primary flow path 144, and a secondary containment flow path 146.

Figure 14:
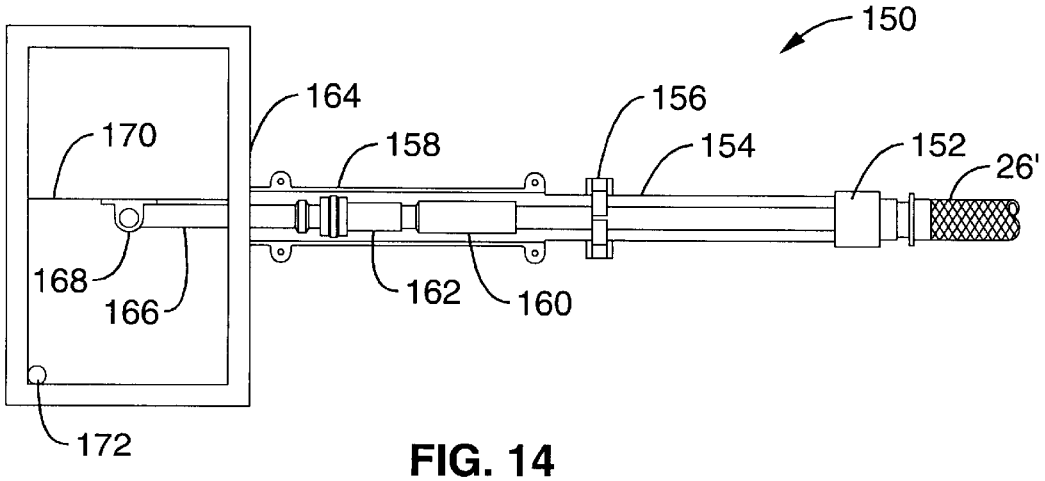
FIG. 14 is a top view of a hose connection to a fuel dispenser shown with a dispenser pan according to an aspect of the present invention.
Figure 15:
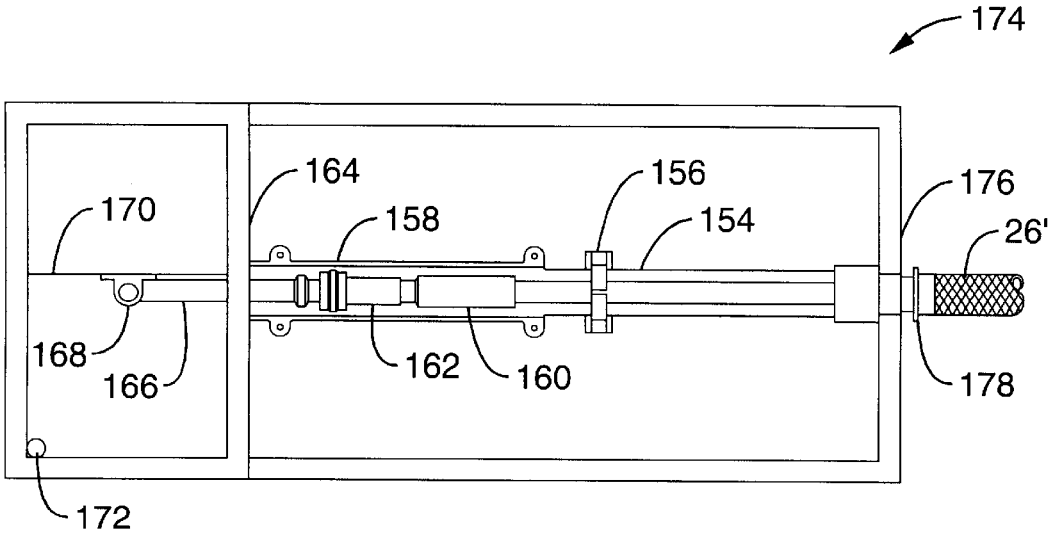
FIG. 15 is a top view of a hose connection to a fuel dispenser shown with both a dispenser pan and a transition pan under the breakaway and other fuel line couplings, according to an aspect of the present invention.
Figure 16:
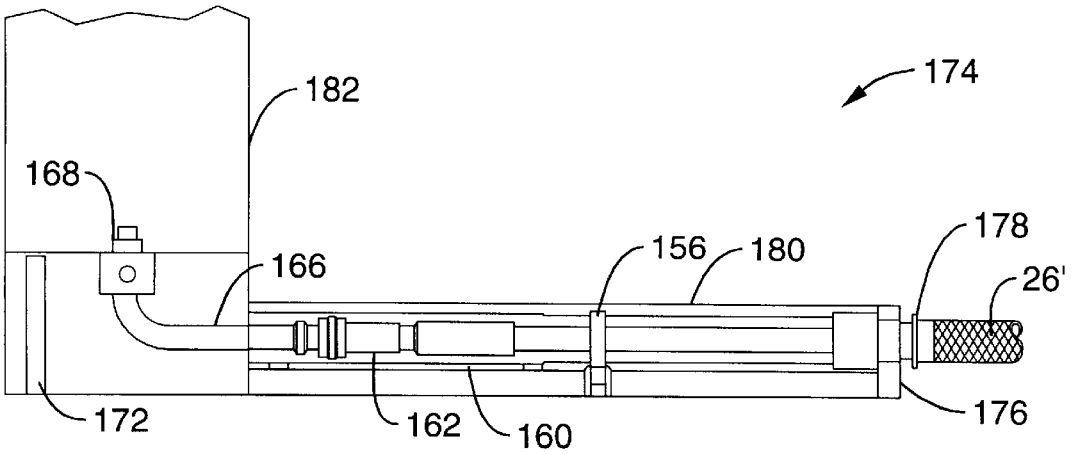
FIG. 16 is a side view of the fuel dispenser connection of FIG. 15.

A major object of the suspended fuel system of the present invention is the ability to safely convey fuel from the shore to the dispenser, and accordingly the system provides secondary containment along the fuel path as well as additional safety features. In maintaining this preferred double-containment safety throughout, the system is additionally configured with secondary containment and other safety features incorporated at the connection with the dispenser. FIG. 14 through FIG. 16 illustrate fuel hose connections to a representative fuel dispenser. In FIG. 14, a dispenser connection embodiment 150 provides direct connection to a dispenser, wherein a flex-to-rigid pipe connector 152 in connection with a rigid fire-rated three-inch pipe 154. The flexible double-wall fuel hose 26' attaching to pipe section 154 preferably comprises a fire rated section of hose, such as a Hosemaster® fire-rated three-inch flex connector. It should be recognized that superior fire safety is provided by utilizing only fire rated hoses (rigid and flexible) on the dock structure. The rigid three-inch pipe 154 is supported by support 156 that leads into a five-inch pipe 158 which transitions from the three-inch pipe, for example, by means of a grooved pipe reducing coupling. The five-inch pipe 158 is configured to be slid away to gain access to internal plumbing of the primary pipe section that herein are exemplified as a primary breakaway 160, such as a 1½ inch OPW® breakaway, and a service disconnect 162, also often referred to as a quick coupling. A dispenser pan 164, shown under the dispenser, provides for collection of any fuel that may leak from the dispenser. The dispenser pan is adapted with a 1½ inch steel nipple welded through it to connect to the primary pipe and the surrounding five-inch secondary containment pipe so as to retain secondary containment. The primary rigid pipe 166 enters the dispenser pan and is configured with an upward bend to a double-poppet safety valve 168 attached to a mounting bracket 170. The double-poppet safety valve 168 automatically shuts down fuel flow to the dispenser in the event of a fire or a mechanical displacement of the dispenser. A variety of double-poppet safety valves are available, Universal Valve Company® is one such manufacturer. The actual dispenser is mounted to the dispenser pan 164 and connected with the double-poppet safety valve 168. It should be appreciated that fuel leaks from the primary pipe, or hose, at any point along the span from the shore, will be collected by the surrounding secondary pipe, or hose, to run downhill into the dispenser pan 164. A fuel monitor 172, such as a Bordeux® positive shutdown system, is preferably incorporated into the dispenser pan 164. Therefore, upon fuel being detected in the dispenser pan, a positive shutdown is engaged and fuel spillage is prevented. Furthermore, it should be recognized that no plastic parts, which are frangible and subject to heat related failure, are utilized along the fuel hose path. In addition, the secondary containment which is provided even in the transition housings are capable of meeting the associated UL requirements.

Additional protection is provided by adding an additional transition pan as shown in an embodiment 174 of FIG. 15 to the dispenser pan. The transition pan 176 contains a coupling 178 from the flex double-wall fuel hose 26'. The side view of FIG. 16 clearly shows how the dispenser 182 mounts atop the dispenser pan 164. The transition pan 176 is configured with a transition pan lid 180 to maintain secondary containment within the enclosure. The fuel conveyance system may be outfitted with various safety options; for example, a fire suppression system may be added to the dispenser pan along with an upgraded monitoring system, such as a fusible fire monitoring system for use with an automatic shutdown device.

The dispenser and transition pans are preferably fabricated from galvanized or Line-X® coated steel and dimensioned to accommodate the dispenser connection thereto. A pan for a typical dispenser should be constructed to retain a number of gallons, i.e. twenty-four, so as to contain a sufficient quantity of leakage.

Figure 17:
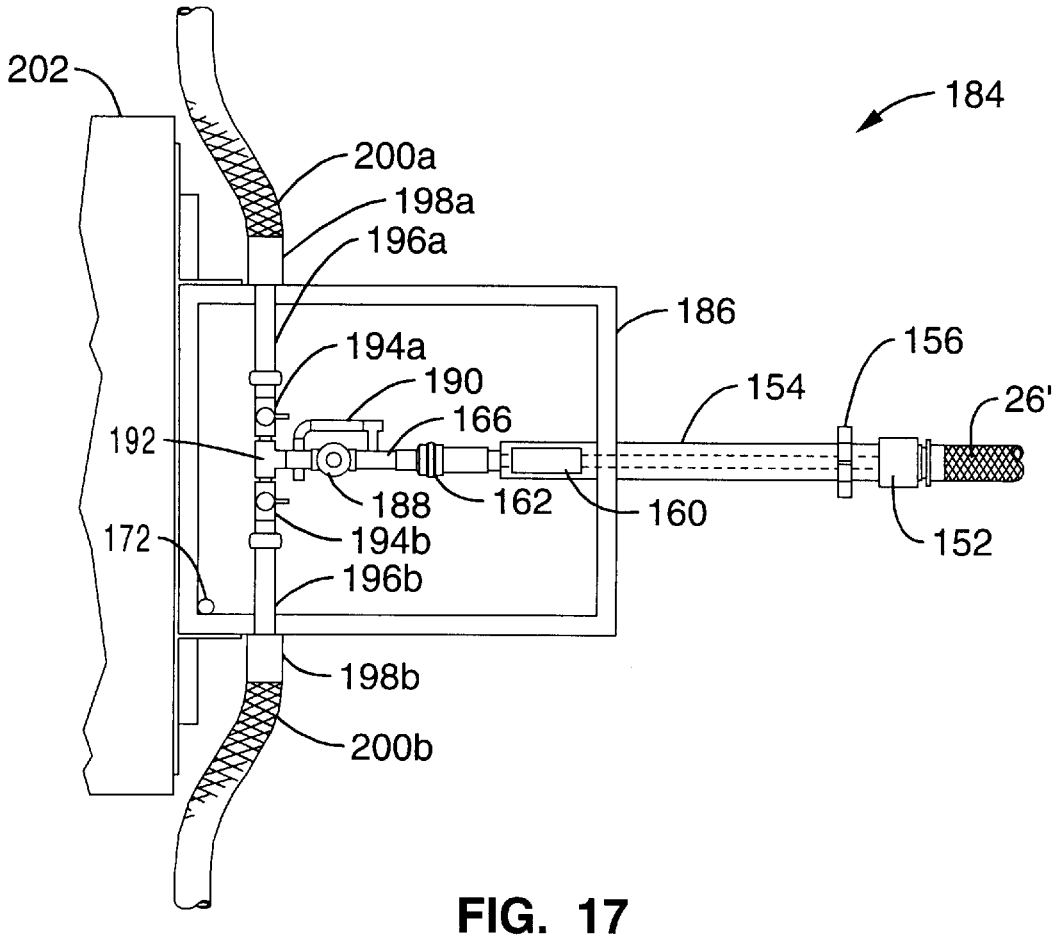
FIG. 17 is a top view of a remote fuel connection according to an aspect of the present invention which maintains secondary containment on transitioning from a single fuel hose input to a pair of output lines.
Figure 18:
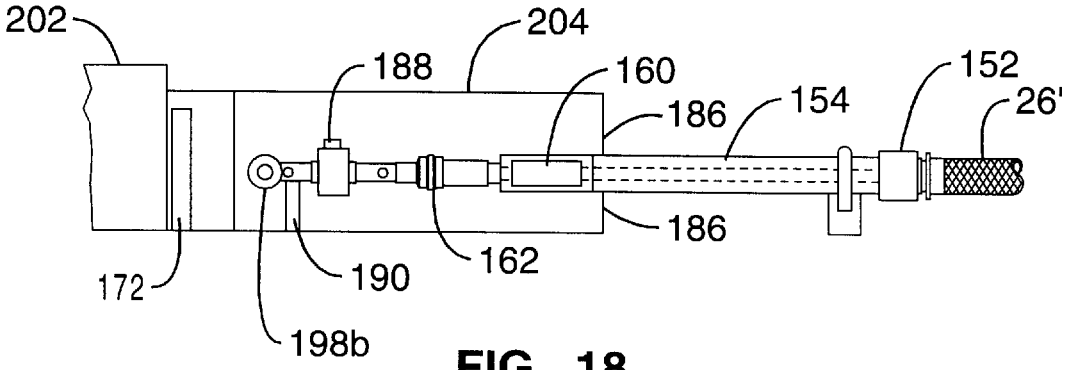
FIG. 18 is a side view of the remote fuel connection of FIG. 17.

Numerous floating dock installations are outfitted with multiple remote dispensers supplied from a single fuel line from the shore. FIG. 17 and FIG. 18 illustrate a remote fuel connection embodiment 184 wherein the plumbing for a remote system splitter is housed within a transition pan 186. The flexible fuel hose 26' is connected through a flex-to-rigid pipe connector 152 to a rigid double-wall pipe section 154 of any length. A transition pan 186 receives the nested primary and secondary pipes. It will be recognized that the rigid pipe section may be of a length that provides routing along a section of dock, or it may be eliminated and the flexible hose connected directly to a connector fitted on the transition pan 186. Within the transition pan 186, are a primary breakaway 160 housed within a section of rigid pipe, which is configured to be slidably removed to gain access to the breakaway. A quick disconnect 162 is also located on the primary pipe section 166 which is connected to an in-line electric emergency shut-off valve 188 that shuts down the fuel when power is disrupted. A bypass pressure relief valve 190, such as manufactured by Morrison®, is provided to accommodate thermal expansion of the fuel should a dock fire or other event cause activation of the emergency shut-off valve. The fuel flow is then split by a T-fitting 192 that separates the flow toward separate ball valves 194*a*, 194*b*, and primary pipe sections 196*a*, 196*b*, to flex pipe connections (primary and secondary) 198*a*, 198*b*, to which fire-rated flex hose 200*a*, 200*b*, are shown connected and routed along dock 202. The transition pan 186 is sealed with a pan lid 204, as shown in FIG. 18, such that the transition pan provides secondary containment for the plumbing contained within. A fuel monitor 172 is preferably utilized within the transition pan to detect fuel leakage. The monitoring system should be configured to require dispenser pump circuit restarting from a land-based power supply to prevent a dock-side override of the emergency shutdown without first performing a complete inspection of the hose, hose reel, and above-ground tank equipment.

Figure 20:
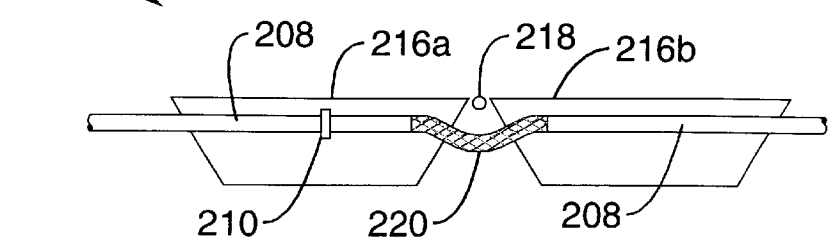
FIG. 20 is a side view of flexible hose used between articulated sections of a floating dock according to an aspect of the present invention.
Figure 19:
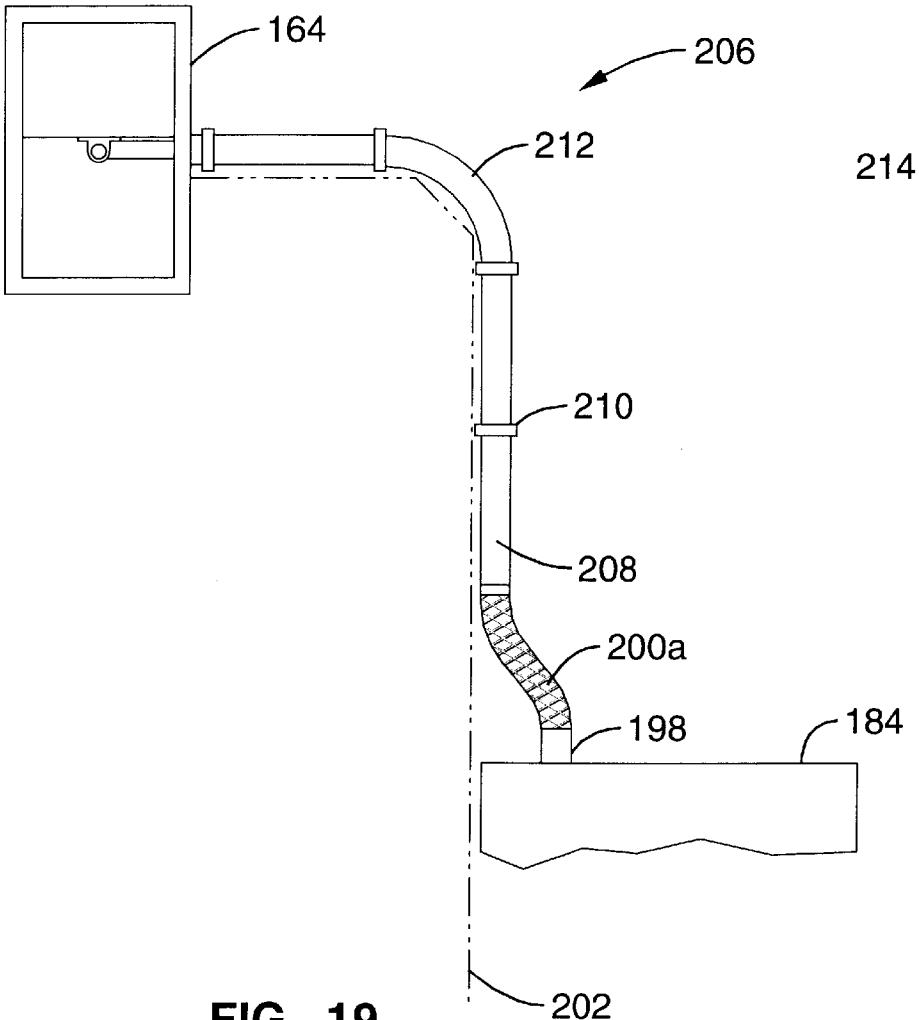
FIG. 19 is a top view of fuel hose routing within rigid pipes while maintaining secondary containment along a dock section according to an aspect of the present invention.

A favored method of conveying fuel along rigid sections of dock to one or more dispensers is through a fire-rated rigid pipe; as these rigid pipes exhibit a high level of durability. In order to enhance safety, the system of the present invention conveys fuel within a primary pipe that is surrounded by a secondary containment vessel, or pipe. FIG. 19 illustrates an embodiment 206 wherein rigid pipe is configured with secondary containment from a transition pan 184 of a remote fuel selector to a dispenser pan 164 along a dock. The rigid pipe is exemplified by steel pipe, such as a Victaulic® piping system which provides fire protection. A double-wall flex hose 200*a* is connected from the output connector 198 of the transition pan 184 to the rigid dual-wall pipe 208, which comprises sections of steel pipe which are interconnected with couplers 210 and routed to the dispenser pan 164. The rigid piping is shown including an elbow 212 of 24-inch radius, which is attached on a corner of the dock. Alternatively, flex hose may be substituted wherein a section of fire rated flex hose provides secondary containment for a flexible primary hose. The rigid piping may b e attached to the dock by means of an attachment system such as the galvanized connection system manufactured by Unistrut™, although alternative connection systems are produced by other manufacturers. FIG. 20 illustrates how the double-wall rigid pipe may be run 214 on an articulated section of dock, shown here comprising two sections 216*a*, 216*b*, connected by a hinge 218. A transition from sections of rigid pipe 208, connected by connectors 210, to a flex hose section 220 between the articulated dock sections provides the necessary flexibility while maintaining the secondary containment which extends out to the fuel dispenser. The sections of flexible double-wall fuel hose shown in FIG. 19 and FIG. 20 are preferably fire rated hoses, such as a Hosemaster® fire-rated three-inch hose.

Figure 21:
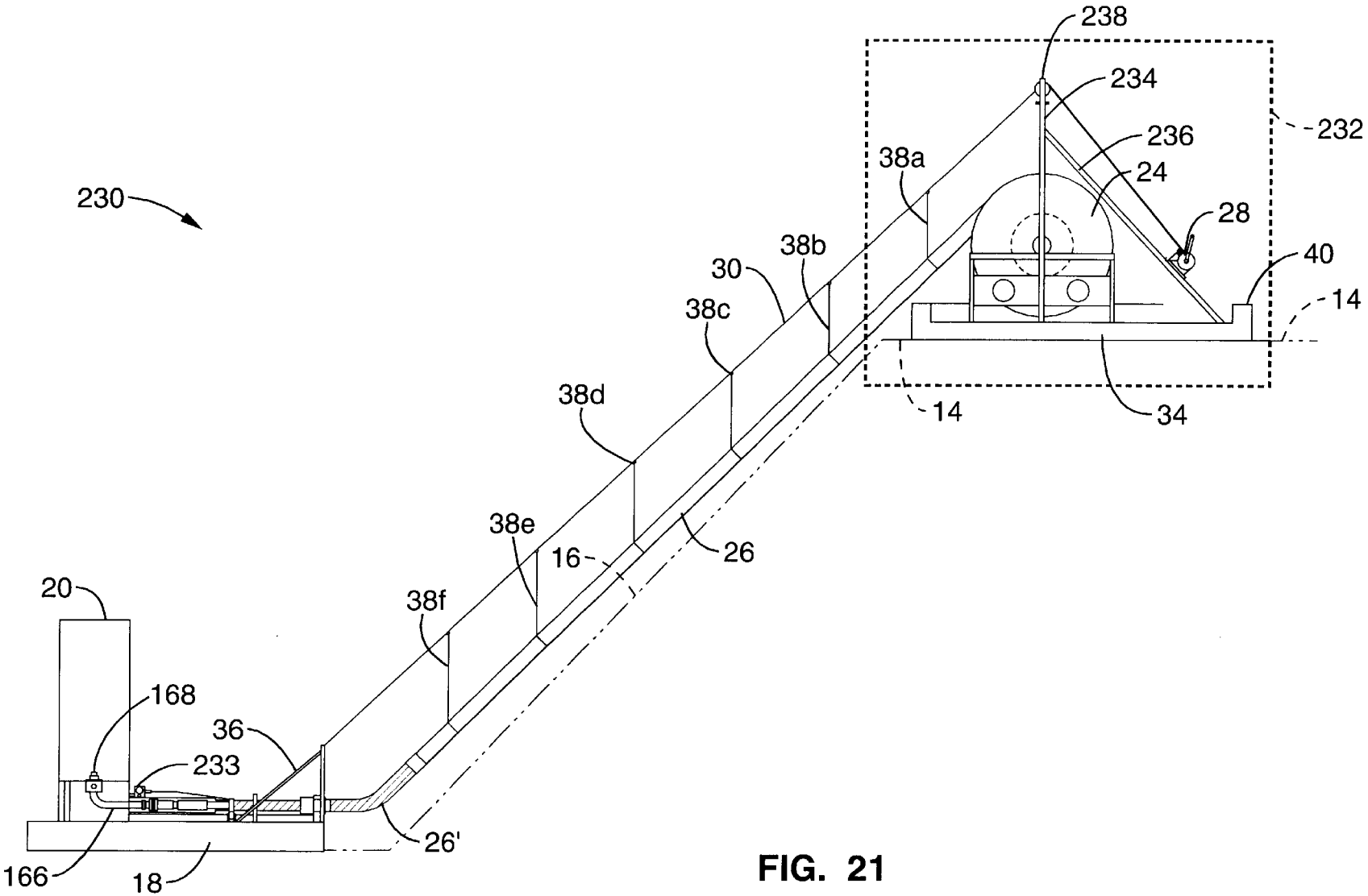
FIG. 21 is a side view of a cable support device according to an embodiment of the present invention, shown as an A-frame support from which a cable and fuel hose are extending to connect with a floating dock.
Figure 22:
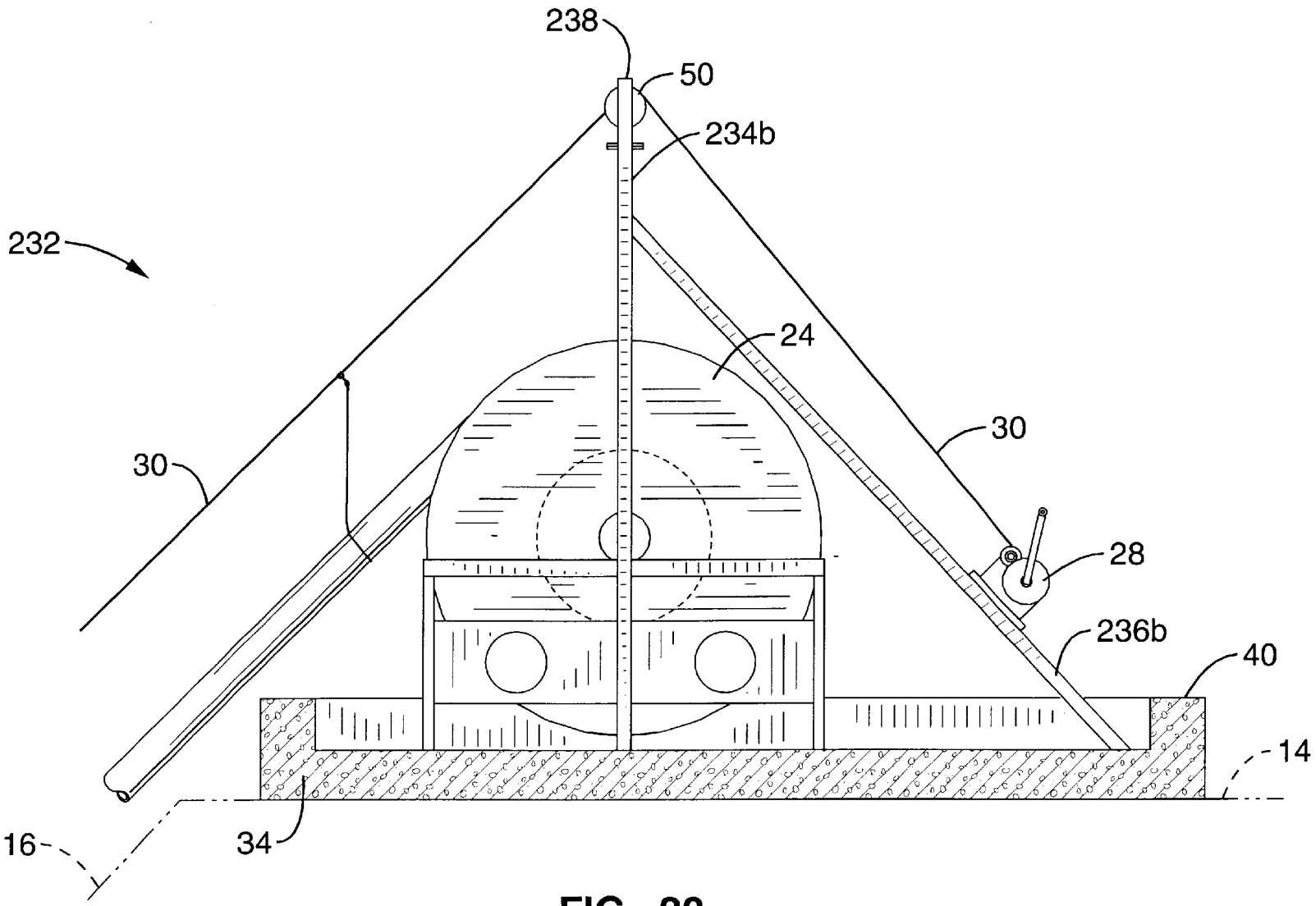
FIG. 22 is a detailed side view of the cable support device shown in FIG. 21.
Figure 23:
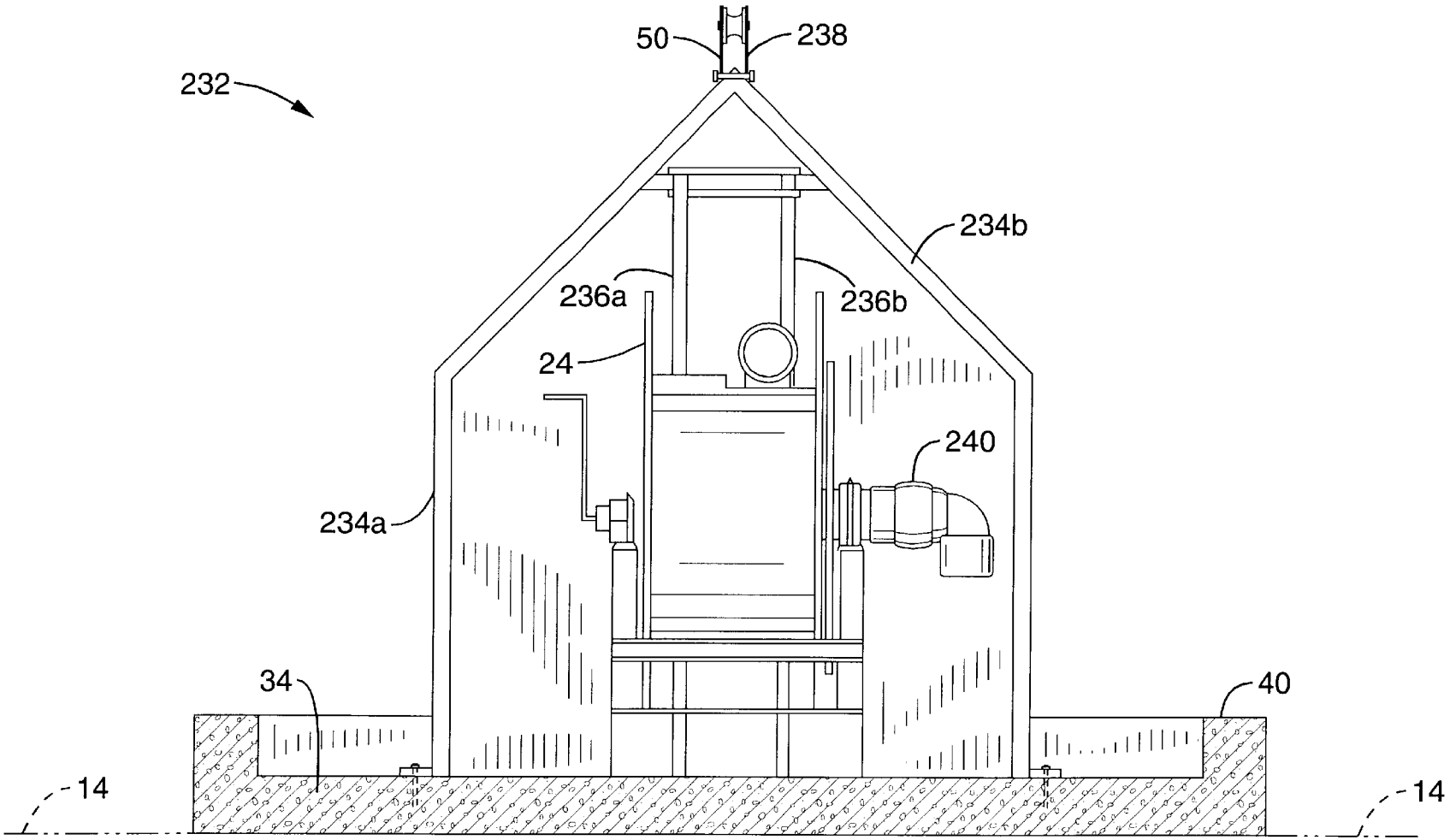
FIG. 23 is a front view of the cable support device shown in FIG. 22.

The cable support structure of FIG. 1 supported cable a substantial distance above the ground at the shore to provide sufficient fuel hose clearance above the terrain even with a long span of outstretched cable. It will be appreciated, however, that such long hose spans are not necessary within every installation. FIG. 21 through FIG. 23 illustrate another embodiment 230 of a cable support structure 232 that can be used for a short-run suspended fueling system more typical of a dock utilized on a river. The A-frame cable support structure 232 is positioned within a containment basin 34 at the top 14 of a small embankment 16 whose terrain slopes downward to a floating dock 18. A fuel dispenser 20 on the floating dock is supplied with fuel from a primary fuel pipe 166 through a double-poppet safety valve 168. Electricity is provided to the dispenser 20 by way of an electrical breakaway 233, which provides for a controlled explosion-proof electrical disconnection upon a sufficient force application between the dispenser 20 and the electrical attachment on the floating dock. The A-frame cable support provides for the extension and retraction, by reel 24, of a fuel hose 26, and by reel 28 of a cable 30, which spans the distance between the shore-side support 232 and a floating dock 18. As in FIG. 1, the hose 26, 26'is supported beneath a cable 30 whose far end is connected to a support structure 36 on the floating dock. The hose 26 is connected to the cable 30 by lanyards 38*a* through 38f. FIG. 22 and FIG. 23 provide a detailed view of the A-frame cable support structure 232 having vertical supporting A-frame structure having A-frame support members 234*a*, 234*b*, and a pair of angled support legs 236*a*, 236*b*, upon which the cable reel 28 is mounted. A sheave 50, for supporting and directing the cable, is mounted within a sheave mount 238 positioned above the A-frame structure. It will be appreciated that the snap-link and lanyards are removed prior to traversing the sheave so that only the D-shackle need traverse the sheave as it moves to, or from, the cable reel. As a result, the mechanism used for redirecting the lanyard around the sheave is not necessary. It will be appreciated that in certain installations the cable reel itself may be capable of directing and supporting the cable above the hose reel; which would allow the elimination of the cable sheave. FIG. 23 shows a fuel hose to reel connector 240, which couples a source of fuel to the hose attached to the reel.

Figure 24:
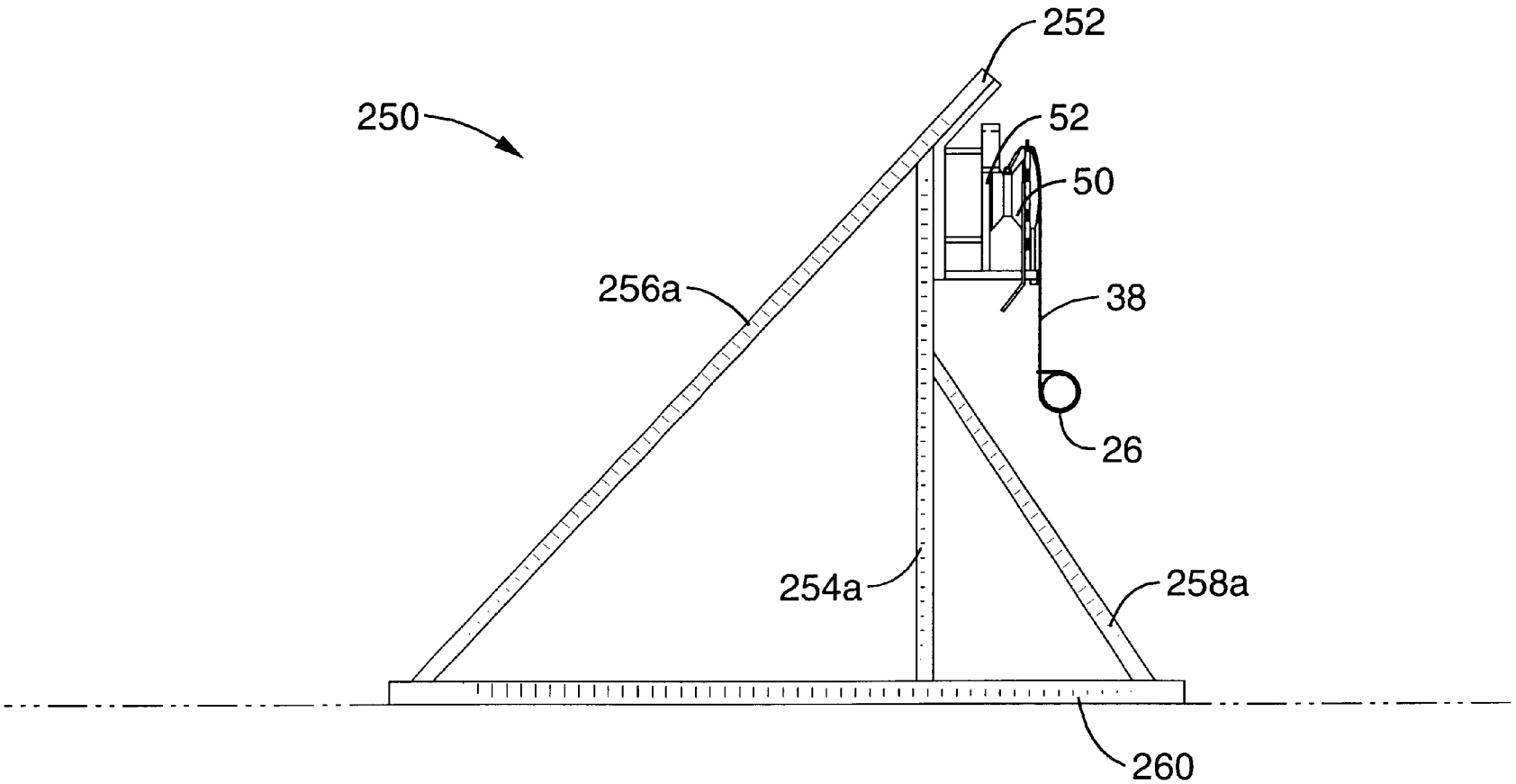
FIG. 24 is an end view of a mid-span cable support structure according to an aspect of the present invention.
Figure 25:
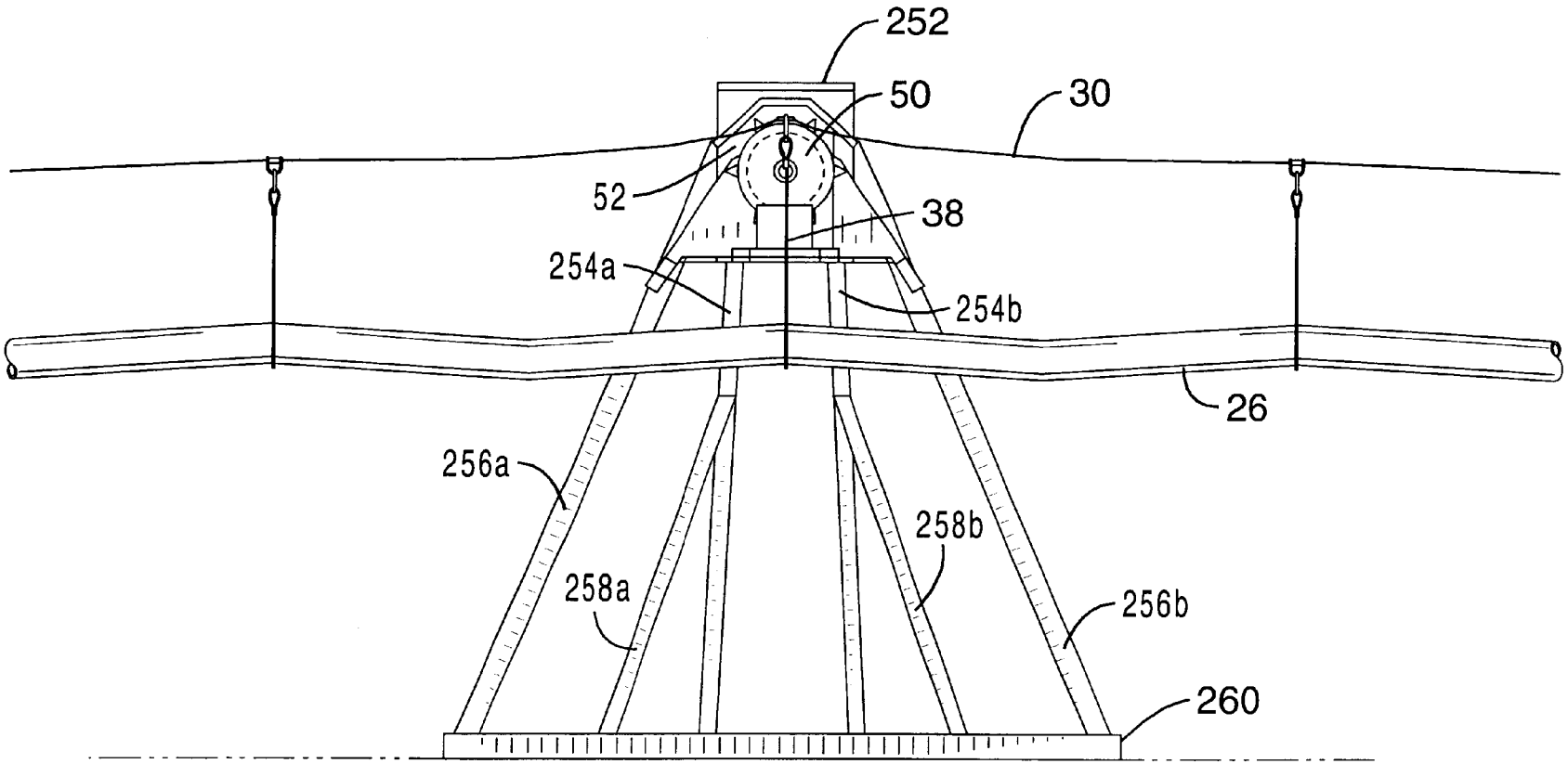
FIG. 25 is a front view of the mid-span cable support structure of FIG. 24.

The suspended marina/watercraft fueling system of the present invention allows the suspension of the fuel hose above a large span of terrain. It will be appreciated that since the amount of cable tension is dependent on the distance being spanned, very long spans could require the use of very strong cable and supporting structures. Therefore, one or more mid-span supports may be utilized for supporting these long spans of fuel hose so that the requirements on cable tension, and thereby structural strength, may be eased. FIG. 24 and FIG. 25, illustrate an embodiment 250 of one such mid-span support that contains a sheave 50 retained on a housing 52 which is similar to the cable support structure of FIG. 6 and FIG. 7. During retraction or extension, the lanyards 38 are directed around the sheave 50, thereby passing the sheave without the need of disconnection and subsequent reconnection. The sheave 50 and housing 52 are retained on a welded steel structure having vertical center legs 254*a*, 254*b*, back legs 256*a*, 256*b*, and forelegs 258*a*, 258*b*. The lower end of the support legs are attached to a base support 260. The mid-span support is preferably non-permanently mounted to the terrain, such that it may be removed when the water level is high, or if it would otherwise interfere with the dock. Multiple mid-span supports may be utilized if an extremely large fuel hose span is contemplated. It will be appreciated that a variety of alternatives exist for providing a mid-span support, wherein the support structure and the method by which the weight of the cable with the attached lanyards is transferred across the structure may be varied. An example of a less-preferred alternative mid-span support can be fabricated using a wide horizontal roller at the top of a structure, whereby the hose is lifted up into a position horizontal with respect to the cable as it transits the roller.

Accordingly, it will be seen that this invention provides a system and method for suspending a fuel hose above terrain and waterways to cross a span between the shore and a floating dock. The length of the fuel hose may be adjusted to accommodate changing waterway conditions and the system may be configured for use with a variety of waterways, such as lakes, rivers, and oceans. It will be appreciated that the system may be utilized for the conveyance of any liquid between any two points that are subject to changes in relative position to one another. Although reels were described for controlling the length of the cable and the suspended hose, it will be understood that alternative length adjusting mechanisms may be utilized. Two embodiments of the system were described for conveying fuel, however, it must be recognized that a variety of supporting structures could be utilized without departing from the present invention. Furthermore, the numerous specifics provided in reference to the exemplified embodiments represent preferred use within the embodiment under a given set of conditions and these specifics are not to be construed so as to limit the scope of the described invention. Additional major aspects of the invention were disclosed, including an ability to route a fuel hose suspended below a cable, so that it traverses a sheave without the disconnection of the fuel hose from the cable. Another major aspect of the system is the ability to provide for secondary containment from a fuel source on the shore to a fuel dispenser on a floating dock. The use of secondary containment prevents environmental contamination in the event of a failure at some point in the primary fuel supply. Additional aspects of the system were also described, such as dual-wall breakaway disconnects, mid-span support structures, monitoring for fuel leaks, automatic fuel shut off systems, and structural containment reservoirs.

Although the description above contains many specificities, these should not be construed as limiting the scope of the invention, but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for conveying liquids between two locations wherein at least one of said locations is floating on a waterway, comprising:

(a) means for spanning a distance between two locations while supporting a distributed load along the length of the span;

(b) means for conveying a liquid between two locations, wherein the means for conveyance of the liquid is suspended at intervals beneath the means for spanning the distance; and (c) means for adjusting the length of the distance spanning means and the suspended conveyance means in response to changes in position of at least one of the two locations, whereby portions of the conveyance means are capable of being maintained suspended above underlying physical elements, such as structures, terrain, and bodies of water, despite the changes in relative position between the two locations while liquids are being transferred from one of the locations to the other.

2. An apparatus for conveying fuel from the shore to a floating dock, comprising:

(a) a cable which spans the distance from a floating dock to a point on the shore;

(b) a fuel hose suspended at intervals along the length of the cable and connected from a source of fuel on the shore to a fuel dispensing system on the floating dock; and (c) means for retracting and extending the cable and fuel hose suspended thereto in response to changes in position of the floating dock, whereby the fuel hose may be maintained above underlying physical elements, such as structures, terrain, and bodies of water, along the path between the point on the shore and the floating dock.

3. An apparatus as recited in claim 2, wherein the fuel hose is suspended beneath said cable at intervals by lanyards which connect the fuel hose to the cable.

4. An apparatus as recited in claim 3, wherein each lanyard comprises a flexible material configured for attachment to the fuel hose and adapted to provide selectable release whereby the lanyard attachment between the fuel hose and cable may be disconnected to allow the cable and the fuel hose to be separately retracted.

5. An apparatus as recited in claim 4, wherein each lanyard comprises a length of steel cable configured on one end to attach to a fuel hose and configured on the other end for removable attachment from a support cable to which the fuel hose is suspended.

6. An apparatus as recited in claim 2, wherein reels are used for providing said means of retraction and extension of both the cable and the fuel hose.

7. An apparatus as recited in claim 6, wherein the reels comprise a fuel hose reel and a cable reel which are both located at a point on the shore for receiving the cable and the fuel hose from the floating dock which is located below the level of the reels.

8. An apparatus as recited in claim 7, further comprising a fuel containment basin underneath the fuel hose reel which is capable of retaining a quantity of fuel which may leak from the fuel hose and connections therein.

9. An apparatus as recited in claim 2, wherein the fuel hose comprises a primary hose fabricated of materials which render it flame resistant.

10. An apparatus as recited in claim 9, further comprising a secondary containment hose annularly disposed on the primary hose for the collection of fuel which may leak from the primary hose, whereby the combination of primary hose and secondary hose may be considered a double-wall fuel hose.

11. An apparatus as recited in claim 10, further comprising a breakaway fuel disconnect capable of being connected along the length of double-wall fuel hose, said breakaway fuel disconnect being separable into two mating halves that in combination provide a primary pipe and an annularly disposed secondary pipe attached thereto, wherein fuel may pass separately within the primary or secondary pipe until a sufficient force is applied to the breakaway to induce separation of the two halves of the breakaway disconnect, and wherein positive fuel shutdown occurs within each half of the primary pipe upon separation, such that uncontrolled fuel spillage is prevented.

12. An apparatus as recited in claim 2, further comprising an electrical cord running a substantial portion of the length of the fuel hose.

13. An apparatus as recited in claim 12, wherein the electrical cord is contained within the portion of the fuel hose that provides secondary containment.

14. An apparatus as recited in claim 13, wherein the electrical cord exits the secondary containment through a liquid-tight coupler fitting attached to the secondary containment hose.

15. An apparatus as recited in claim 12, further comprising an electrical breakaway device along the electrical cord which is capable of disconnecting the electrical power upon the application of a sufficient force.

16. An apparatus as recited in claim 2, wherein the floating dock is equipped with one or more fuel dispensers for the regulated dispensing of fuel into watercraft.

17. An apparatus as recited in claim 16, further comprising a remote fuel connection enclosure for use in routing fuel to remote fuel dispensers, wherein the remote fuel connection enclosure is configured to connect with multiple double-wall fuel pipes, whereby that the fuel pipes and fittings utilized within the remote fuel connection enclosure may be single-wall plumbing devices about which the remote fuel connection enclosure provides secondary containment.

18. An apparatus as recited in claim 16, further comprising a fuel dispenser pan underneath the fuel dispenser for containing any fuel which may leak from the fuel dispenser.

19. An apparatus as recited in claim 18, further comprising a fuel monitor within the fuel dispenser pan that upon detecting the presence of fuel in the dispenser pan generates a signal that may be used for positively shutting down fuel flow within the system to prevent further leakage.

20. An apparatus as recited in claim 18, wherein the walls of the dispenser pan are configured to provide a primary fuel pipe path toward a connection with the dispenser, and configured so that fuel collected in the secondary fuel pipe may enter the dispenser pan.

21. An apparatus as recited in claim 20, wherein the dispenser pan is connected with double-wall rigid fuel pipes for the receipt of fuel for the dispenser and the collection of fuel leakage in the dispenser pan.

22. An apparatus as recited in claim 21, further comprising a service disconnect on the primary pipe contained within a suitably sized secondary pipe that connects with the dispenser pan, wherein the secondary pipe is configured to provide removable access to the service disconnect on the primary pipe.

23. An apparatus as recited in claim 21, further comprising a breakaway disconnect on the primary pipe contained within the suitably sized secondary pipe that connects with the dispenser pan, whereby upon the application of excessive force between the fuel dispenser and the pipes attached thereto, the breakaway disconnect can separate and stop fuel flow before the excessive force builds to a high enough level of force to cause rupturing of the primary pipe and consequent fuel leakage.

24. An apparatus as recited in claim 18, further comprising a transition pan proximal to said dispenser pan wherein the primary pipe along with the fittings and valves attached thereto are contained within an enclosure which provides secondary containment for fuel which leaks from the primary pipe or fittings and valves attached thereto.

25. An apparatus as recited in claim 2, further comprising an electric fuel flow valve along the fuel hose proximal to the floating dock which is capable of prohibiting fuel flow through the hose upon interruption of electric power.

26. An apparatus as recited in claim 25, further comprising a fuel bypass valve attached proximal to the electric fuel flow valve which allows controlled incremental fuel flow around the electric fuel flow valve back toward the fuel source on the shore in response to thermal expansion of the fuel.

27. An apparatus as recited in claim 2, further comprising a cable support structure located at the point on the shore and configured to support and guide the cable attached to the floating dock towards the means for retracting and extending the cable.

28. An apparatus as recited in claim 27, wherein the cable support structure comprises a cable sheave rotatably mounted within the structure, such that the sheave supports the weight of the cable, along with the fuel hose suspended underneath, and rotates in response to cable movement.

29. An apparatus as recited in claim 28, wherein the cable support structure and the mechanism for redirecting the fuel hose comprise a cantilever mounted sheave having a sufficient amount of free space one side of the sheave through which the fuel hose support may pass after being directed to that side of the sheave by a deflector member.

30. An apparatus as recited in claim 29, wherein the cantilever mounted sheave is adapted with protruding cogs for catching a portion of the fuel hose support to urge it past the sheave during movement of the cable.

31. An apparatus as recited in claim 27, wherein the cable support structure further comprises a mechanism for redirecting the fuel hose being supported under the cable such that the fuel hose which is suspended at intervals along the length of the cable is capable of retraction or extension past the cable support member without the need of disconnecting the support between the cable and the fuel hose.

32. An apparatus for providing controlled separation between two sections of fuel pipe, each section of fuel pipe being configured with a secondary containment pipe surrounding a primary fuel pipe, comprising:

(a) a primary fuel pipe adapted for separation into two sections upon the application of a predetermined force;

(b) a valve configured within at least one of the separable sections of primary fuel pipe, wherein the valve is capable of closing in response to separation of the two sections such that fuel flow is afterward prevented through that section; and (c) a secondary containment pipe adapted for separation into two sections upon the application of a predetermined force, wherein each section is annularly disposed about one of the two sections of separable primary fuel pipe and attached thereto, whereby fuel may be carried through the secondary containment pipe surrounding the primary fuel pipe until the application of a force which exceeds the predetermined separation forces such that simultaneous controlled separation occurs in the primary fuel pipe and secondary containment pipe and fuel flow is prevented through at least one half of the primary fuel pipe.

33. An apparatus as recited in claim 32, wherein each of the separable sections of the primary fuel pipe is configured with a valve that prevents fuel flow through the section upon separation of the two halves of the section.

34. A method of conveying fuel to floating fuel docks, comprising:

(a) connecting a cable between a floating dock and a point on the shore;

(b) suspending a fuel hose beneath the cable wherein the fuel hose is connected to a source of fuel from the shore; and (c) configuring take up reels for the cable and fuel hose whereby the length of the cable and fuel hose may be adjusted in accordance with changing distances between the floating dock and the point on the shore to which the cable and fuel hose are connected.

35. A method as recited in claim 34, further comprising connecting the fuel hose to the floating dock with a breakaway fuel coupling which cuts off the fuel flow in the event that the floating dock is sufficiently displaced, such as by a collision from a watercraft.

36. A method as recited in claim 35, further comprising surrounding the primary hose with a secondary containment hose to collect and gather any fuel leaking from the primary hose.

37. A method as recited in claim 36, further comprising maintaining secondary containment within transition enclosures which are capable of receiving double-wall pipes so that single-wall plumbing fittings may be utilized within the enclosure while the enclosure provides the secondary containment for the single-wall pipes and fittings contained therein, and the enclosure is fluidly coupled with the secondary containment pipes being received by the transition enclosure.

38. A method as recited in claim 34, wherein the step of suspending the fuel hose beneath the cable is performed by attaching flexible connections between the fuel hose and the cable, wherein the flexible connections may be detached to allow the fuel hose and cable to be taken up on separate reels.

39. A method as recited in claim 38, further comprising supplying electricity to the floating dock by additionally suspending an electrical cord in combination with the fuel hose.

40. A method as recited in claim 34, further comprising the step of containing fuel leaks which may occur at the fuel hose reel by positioning a fuel containment pan, capable of retaining a quantity of fuel, underneath the fuel hose reel.

* * * * *